US007626478B2

(12) United States Patent
Kawai

(10) Patent No.: US 7,626,478 B2
(45) Date of Patent: Dec. 1, 2009

(54) MULTILAYER ALIGNED-WINDING COIL

(75) Inventor: Toshiyuki Kawai, Chiba (JP)

(73) Assignee: Nittoh Denki Company, Limited., Chiba (JP)

( * ) Notice: Subject to any disclaimer, the term of this patent is extended or adjusted under 35 U.S.C. 154(b) by 216 days.

(21) Appl. No.: 12/000,480

(22) Filed: Dec. 13, 2007

(65) Prior Publication Data

US 2008/0150669 A1 Jun. 26, 2008

(30) Foreign Application Priority Data

Dec. 25, 2006 (JP) ..... 2006-347077

(51) Int. Cl.
*H01F 27/28* (2006.01)
*H01F 41/06* (2006.01)

(52) U.S. Cl. ..... 335/299; 336/189; 336/224

(58) Field of Classification Search ..... 335/299; 242/174, 176, 178; 336/189, 224
See application file for complete search history.

(56) References Cited

FOREIGN PATENT DOCUMENTS

JP 2000-245092 A 9/2000

JP 2001-196238 A 7/2001

*Primary Examiner*—Ramon M Barrera
(74) *Attorney, Agent, or Firm*—Rader, Fishman & Grauer, PLLC

(57) ABSTRACT

A multilayer aligned-winding coil (1) of a wide width wire, each layer having an obliquely crossing winding part extending obliquely with respect to a cross-section in one partial angular region of a virtual endless ring defined by the cross-section, and a transverse winding part extending transversely in an other partial angular region, includes a plural pairs of consecutive two layers meeting conditions 1 and 2; 1: a first row of winding portion including a transverse winding part having a progressively riding transverse winding part (YM, YM) riding progressively on a last row of the obliquely crossing winding part of a lower layer of the two layers to reach an upper layer thereover, and 2: a second row of winding portion including a riding and obliquely crossing winding part (RM, RM) having a ride-over region (X2, X4) crossing obliquely from a riding start region of the progressively riding transverse winding part (YM, YM) across a progressive riding region of the progressively riding transverse winding part (YM, YM). At least two pairs of the two layers have the ride-over region parts (X2,X4) at different angular regions (P1, P3) to provide the multilayer aligned-winding coil in which the wide width wire can be wound in multilayer and in alignment stably and at high space factor.

10 Claims, 23 Drawing Sheets

301
PD1
PS2
PS
PS3
PS1
PS4
θ2
θ1
PY
PR

301
PY
PY
PY
PY
θ2
θ1
L(1;4;1)
PR

301
PY
Q2s
PYM1
Q1f

301
PYM1
PRM1

301
PY
PY
PY
PY
θ2
θ1
PR

301

301
PE4
Q3f
PYM3

301
θ1
PYM3
PRM3

MULTILAYER ALIGNED-WINDING COIL

BACKGROUND OF THE INVENTION

1. Field of the Invention

The invention relates to a multilayer aligned-winding coil which is formed by winding, in alignment, a wire of wide width in the form of a multilayer tube.

The "wire of wide width" is referred to, herein, as a wire having a width greater than a thickness and having a region of substantially constant thickness at a widthwise central region thereof. The term "tubular" or "tube" for the multilayer aligned-winding coil is referred to as the coil being in the form or shape of a tube. There may be or may not be a core body inside the tube. When the coil has the core body, the core body may be solid or hollow. The "aligned-winding" of the multilayer aligned-winding coil having a plurality of rows of winding portions, is referred to as a winding where adjacent rows, among majority of rows of said plurality of rows, of winding portions are wound to be arranged substantially in parallel and substantially in close or approximate contact with each other at mutually opposed or faced side edges thereof. More specifically, in a case where the wire of wide width is wound at the same layer as a previously wound portion as the winding of the coil, the "aligned-winding" is referred to as the wire of wide width being wound in alignment with the adjacent winding by being wound on the lower winding layer (or on an outer periphery of the winding core in case of the lowermost layer) with a side edge thereof forced to an adjacent side edge of the lastly wound winding portion so as to follow substantially the lastly wound winding portion or as the coil thus wound. In a case where the wire of wide width forms the first turn of each layer of the coil, "aligned-winding" is referred to as the wire of wide width being wound on the lower winding layer (or on an outer periphery of the winding core in case of the lowermost layer) with a side edge thereof forced to an adjacent support face of a flange so as to follow the support surface or as the coil thus wound.

2. Description of the Related Arts

Conventionally typical example of multilayer aligned-winding coils are two kinds of multilayer aligned coding coil of rectangular wire, i.e., wire having rectangular cross-section, having been developed by the present inventor and was disclosed with illustrations in Japanese Patent Publication No. 2001-196238(A) referred to hereinafter as a patent document 1.

The most typical coil of two kinds is a type of the coil disclosed in FIGS. 1 to 3 of the patent document 1 and has a structure shown in attached drawings FIGS. 17A, 17B and 17C.

In the conventionally typical rectangular wire multilayer aligned-winding coil 101, as shown in FIGS. 17A, 17B and 17C, winding parts at three sides PS1, PS2, PS3 of the coil 101 having a cross-section PV (cross-section perpendicular to the central axis PC1 extending in the longitudinal direction of the coil 101) in the shape of rectangle PS comprise transverse winding parts PY1, PY2, PY3 (shown by reference symbol "PY1" when plural transverse winding parts of the first layer are not distinguished, and further shown by reference symbol "PY" when layers are not distinguished) extending along the cross-section of the multilayer aligned-winding coil 101, and a winding part at the remaining one side PS4 of the rectangle PS comprises an obliquely crossing winding part PR1 (shown by reference symbol "PR" when the layers are not distinguished) extending obliquely with respect to the cross-section to shift by one wire PD1. In this multilayer aligned-winding coil 101, transverse winding parts PY1 are arranged substantially in close contact with each other, and the length of the coil 101 is substantially integral multiple (5 times in the illustrated case) of the width of the transverse winding part PY. In this multilayer aligned-winding coil 101, turning points PT1, PT3 between the obliquely crossing winding part PR1 and the transverse winding parts PY1, PY3 are formed at corners PK1, PK4. As shown in FIG. 17B, a transverse winding part PY2 progressively ride on an obliquely crossing winding part PR1F at the last row of the first layer PL1 of the multilayer aligned-winding coil 101. Thus, a progressively riding part PZ is formed, where the progressively riding part PZ is situated at a region, of the side PS4, close to the corner PK4. As shown in FIG. 17C, the second layer PL2 of obliquely crossing winding part PR2 includes a first row of obliquely crossing winding part PR21 extending to follow side edges, at the second row side, of the progressively riding part PZ and consecutive transverse winding part PY21. In this case, the obliquely crossing winding part PR21 of the second layer is situated at a side PS3 which is more upstream-side by one than the obliquely crossing winding part PR1 of the first layer in view of the winding direction of the wire. The aligned-winding of the second layer is made in the same way as the winding of the first layer except the above-mentioned point. The winding of the third and further layers are made in the same way.

In this type of rectangular wire multilayer aligned-winding coil 101, as seen from FIG. 17C, for example, on the side PS3 where an obliquely crossing winding part PR21 at the first row of the second layer and a transverse winding part PY12F at the last row of the first layer situated thereunder are partially superposed, a gap PG1 is produced. The gap PG1 is relatively large (having a volume of about a half of that of a transverse winding part PR2), and therefore the space factor of the multilayer aligned-winding coil 101 is reduced by the amount corresponding to the volume of the gap PG1. The gap PG1 is produced at every region between the layers. The reduction in the space factor becomes conspicuous when the multilayer aligned-winding coil 101 has many layers. In particular, as the number of rows of windings constituting the multilayer aligned-winding coil 101 becomes smaller, the reduction in the space factor becomes larger and not negligible.

Another type of multilayer aligned-winding coil the inventor proposed in the patent document 1 is disclosed in FIG. 10 of the patent document 1 and has a structure shown in the attached drawings FIGS. 18A, 18B and 18C.

This second type of multilayer aligned-winding coil 201 is, as shown in FIGS. 18A, 18B and 18C, the same as the multilayer aligned-winding coil 101 of FIGS. 17A to 17C on the point that the wire PD1 of wide width such as the rectangular wire is wound in alignment in the form of a multilayer hollow rectangular cylinder 202 and on the point that each layer PL has an obliquely crossing winding part PR extending in an oblique direction PB1 with respect to the cross-section PV (virtual plane substantially perpendicular to the longitudinal axis PC1 of the tube) of the tube at one continuous angular region PS4 (one side of four sides PS1, PS2, PS3, PS4 constituting the rectangle PS in this case) of virtual endless ring PS (rectangle in this case) defined by the cross-section of the tube 202, and transverse winding parts PY11, PY12, PY13 extending in the transverse direction PF along the cross-section PV at remaining angular regions PS1, PS2, PS3 of the endless ring PS.

However, in the second multilayer aligned-winding coil 201, as seen from FIG. 18A, the length of the coil 201 is longer than the integral multiple (5 times in the illustrated case) of the width of each of the transverse winding parts PY arranged in substantially close contact with each other by a width of a gap PG2 (the width of the gap PG2 is fairly smaller than the width of the rectangular wire PD1), and plurality of pairs of two consecutively superposed layers PLa, PLb meeting the following two conditions (1) and (2) are provided.

Condition (1)

As shown in FIG. 18B, provision of the first row of winding portion PW1 in the form of first transverse winding part PYA including a progressively riding transverse winding part PYM which ride progressively on the last low of obliquely crossing winding part PRF at a lower layer PLa of two layers PLa, PLb to reach from the lower layer PLa to an upper layer PLb thereover by one layer.

Condition (2)

As shown in FIG. 18C, provision of the second row of winding portion PW2 including a riding and obliquely crossing winding part or progressively riding and obliquely crossing winding part PRM extending to obliquely cross from a riding start region, of the progressively riding traverse winding part PYM of the first transverse winding part PYA, where the riding thereof on the obliquely crossing winding part PRF is started across a progressive riding region superposing at least partially on the obliquely crossing winding part PRF, and descending down at an extended end on the obliquely crossing winding part PR of the lower layer PLa, and a second transverse winding part PYB turning at a turning point PTC at the extended end of the riding and obliquely crossing winding part PRM to extend along a side edge PE2, at a side of the second row, of the first row of transverse winding part PYA in said transverse direction PF.

In the second type of rectangular wire multilayer aligned-winding coil 201, the third layer PL3 (not shown) of winding wire is wound on the second layer PL2 of wire in the same way as the second layer PL2 of winding wire is wound on the first layer PL1 of wire, and the fourth layer PL4 (not shown) of winding wire is wound on the third layer PL3 (not shown) of wire in the same way as the third layer PL3 (not shown) of winding wire is wound on the second layer PL2 of wire, and such superposition of layers are repeated.

More specifically, the riding and obliquely crossing winding parts PRM at the second rows of winding portions PW2 of at least two pairs of said two layers PLa, PLb among the plural pairs of said two layers have ride-over region parts PX, obliquely riding over the progressively riding regions of the progressively riding traverse winding parts PYM, constantly at the same angular region (region of the side PS4 adjacent to the corner PK1 in the illustrated case) in terms of the angular region of the endless ring PS defined by the cross-section of the tube.

In the type of multilayer aligned-winding coil 201, as seen from FIG. 18C, a gap PG3 at the side PS4 where the first row of obliquely crossing winding part PRM at the second layer PLb superposes on the transverse winding part PYA at the last row of the first layer PLa is smaller than the gap PG1 of the first type of multilayer aligned-winding coil 101, which enhances, by the differences of the gaps (even though the volume of the small gap PG2 is also taken into consideration), the space factor of the multilayer aligned-winding coil 201.

However, the inventor has found it unavoidable that a protrusion PH is formed upstream of turning point PTC in this type of multilayer aligned-winding coil 201, and has further found, after detailed study of the state of the winding wire PD1 of the multilayer aligned-winding coil 201, the followings.

In the multilayer aligned-winding coil 201, a part, of the progressively riding transverse winding part PYM, where the riding and obliquely crossing winding part PRM completes the oblique crossing has approached to the upper layer Lb by the advancement of progressive riding. Therefore, the ride-over region PX, of the riding and obliquely crossing winding part PRM, before descending down from the progressively riding transverse winding part PYM reaches at a position (substantially the third layer when the upper layer is the second layer) fairly higher than the upper layer Lb. More specifically, the ride-over region PX, of the riding and obliquely crossing part PRM, superposing the progressively riding transverse winding part PYM riding on the obliquely crossing winding part PR reaches a position fairly higher than the second layer. On the other hand, a part, of the riding and obliquely crossing winding part PRM, having descended onto the lower layer La is situated at a position just as high as the upper layer La. Therefore, in the ride-over region PX before the turning point PTC between the riding and obliquely crossing winding part PRM and the second transverse winding part PYB, the protrusion PH protruding in an outward direction PJ is formed at and near the corner PK1 of the rectangle or square PS in view of the cross-section PV.

This type of protrusion or projection PH, at the ride-over region PX where the riding and obliquely crossing winding part PRM crosses over across the progressively riding transverse winding part PYM progressively riding the obliquely crossing winding part PR, is unavoidably formed by the superposition of three associated winding parts, and therefore the protrusion PH is formed at any two adjacent layers under thus-described the relationship or conditions.

Therefore, when the superposition of layers are repeated, protrusions PH are formed at substantially the same position in view of the cross-section of the multilayer aligned-winding coil 201. When these protrusions PH are superposed, the magnitude of protrusion becomes larger, which substantially disables or prevents the aligned-winding of wires PD1.

The inventor further improved the second type of multilayer aligned-winding coil and developed an improved rectangular wire multilayer aligned-winding coil and produces and sells the improved rectangular wire multilayer aligned-winding coil. The improved rectangular wire multilayer aligned-winding coil 301 and an outline of the way of winding thereof are shown in FIGS. 19A, 19B, 19C, 19D, 19E, 19F, 19G and 19H. The coil 301 is described in the "Related Art" because the coil 301 itself has been sold as a product and has been used. However, the process or method, per se, of winding the coil 301 is not known to public.

The multilayer aligned-winding coil 301 has, as seen from drawings such as FIGS. 19A and 19B, an obliquely crossing winding part PR at a partial angular region θ1 of one side PS1 of the four sides PS1, PS2, PS3 and PS4 constituting the rectangle or square PS. In the following, multilayer aligned-winding coil is illustrated as each layer thereof having four rows so that the problems in the multilayer aligned coil having been produced and sold can be clearly understood. In addition, each part of the multilayer aligned-winding coil 301 is shown by L(i; j; k) where i=1, 2, 3 or 4; j=1, 2, 3 or 4, k=1, 2, 3 or 4. In this expression, "i" denotes a layer. For example, i=1 corresponds to the first layer (lowermost or lowest layer). Similarly, "j" denotes a row. For example, j=1 corresponds to the first row, which is the right end row for the odd number layer and the left end row for the even number layer. Further, "k" denotes four sides. For example, k=1 corresponds to the first side.

More specifically, as seen from drawings such as FIG. 19A showing the start of winding, FIG. 19B showing a state where the winding of the 3rd turn has been completed, and FIG. 19E showing a state where the winding of the 7th turn has been completed, the multilayer aligned-winding coil 301 has an obliquely crossing winding part PR at a partial angular region θ1 of a winding part L(i; j; 1) constituting a side S1 and a transverse winding part PY at a remaining angular region θ2 of the winding part L(i; j; 1) constituting the side S1. Each of the winding part L(i; j; 2), L(i; j; 3) and L(i; j; 4) each constituting a respective side PS2, PS3 or PS4, consists only of the transverse winding part PY. FIGS. 19C, 19D, 19F, 19G and 19H show respectively the states where 4th turn, 5th turn, 8th turn, 12th turn and 13th turn have been completed and the subsequent turns of winding have been started.

The winding part L(i; 4; k) at the last row of each layer has a form or configuration different from the winding part L(i; m; k) (where m=2, 3) at the other rows of the layer. Similarly, the winding part L(i+1; 1; k) at the first row of an upper layer, i.e. a layer just above the layer, has a form or configuration different from the winding part L(i+1; m; k) (where m=2, 3) at the other rows of the upper layer.

The last winding part L(1; 4; 1) at the fourth row of the first layer, i.e. the last winding part Q1*f* of the fourth turn of wire, as seen from FIG. 19C and FIG. 20A showing an enlarged view thereof, takes not a form of an obliquely crossing winding part PR but a form of a progressively riding transverse winding part PYM1 progressively riding on an obliquely crossing winding part PR situated at the region from the last of the third row L(1; 3; 1) of the first layer to the first of the fourth row L(1; 4; 1). The first winding part at the first row L(2; 1; k) of the second layer, i.e. the first winding part Q2*s* of the 5th turn, typically just rides on the transverse winding part PY which is the first winding part at the fourth row L(1; 4; 1) of the first layer, and is the same as other parts.

The last winding part at the first row L(2; 1; 1) of the second layer, i.e. the last winding part of the 5th turn, as seen from FIG. 19D and FIG. 20B showing an enlarged view thereof, has a ride-over region part PX2 obliquely crossing from the riding start region, where the riding of the progressively riding transverse winding part PYM1 on the obliquely crossing winding part PR is started, across the progressively riding region, of the progressively riding transverse winding part PYM1, which is partially superposed on the obliquely crossing winding part PR. The last winding part takes a form of a riding and obliquely crossing winding part or progressively riding and obliquely crossing winding part PRM1 which descends on the first layer of obliquely crossing winding part at an extended end thereof where the last winding part is turned to follow the shape of the side edge PE2 at the first winding part of the first row of the second layer, on the first layer of obliquely crossing winding parts, to form the first winding part at the second row of second layer.

In the multilayer aligned-winding coil 301, the ride-over region part PX2, of the riding and obliquely crossing winding part PRM1, just before completing the oblique crossing over the progressively riding transverse winding part PYM1 is situated at substantially the third layer because of progress of the progressive riding. More specifically, the ride-over region PX2, of the riding and obliquely crossing winding part PRM1, superposing on the progressively riding transverse winding part PYM riding on the obliquely crossing winding part PR reaches at a position much higher (outer) than the second layer. On the other hand, a site or part, of the riding and obliquely crossing part PRM1, having descended on the lower layer PL1 is situated just at the second layer PL2. Therefore, a protrusion PH2 is formed to protrude outwardly PJ of the rectangle PS in the cross-section PV at the ride-over region PX2 before the turning point PTC2 between the riding and obliquely crossing winding part PRM1 and the second row of transverse winding part PY. As shown in the side view of FIG. 21A, it is unavoidable that the region PX2 before the turning point PTC2 more or less protrudes, as the protrusion PH2, in the outward direction PJ of the rectangle PS. The FIG. 21B is an oblique view similar to FIG. 20B.

Similar protrusion is produced for example at a region between the last winding part at the first row (9th turn) of third layer and the first winding part at the second row (10th turn) of the layer. However, this protrusion is situated at a region near an opposite end in the longitudinal direction of the coil 301.

Further, as seen from FIGS. 19G and 19H as well as FIGS. 22A and 22B showing the enlarged views thereof, similar phenomenon occurs at a region between the last winding part at the first row (13th turn) of the fourth layer and the first winding part at the second row (14th turn) of the layer.

More specifically, the last winding part Q3*f* at the fourth row L(3; 4; 1) of the third layer or at the 12th turn, as seen from FIG. 19G and FIG. 22A, takes not the form of the obliquely crossing winding part PR but the form of the progressively riding transverse winding part PYM3 progressively riding on the obliquely crossing winding part situated between the last region at the third row L(3; 3; 1) of the third layer and the first region at the fourth row of the layer. In addition, the last winding part at the first row L(4; 1; 1) of the fourth layer, i.e. the last winding part of the 13th turn, as seen from FIG. 19H and FIG. 23B, takes a form of a riding and obliquely crossing winding part PRM3, having a ride-over region part PX4 obliquely crossing over the progressively riding transverse winding part PYM3 from a riding start region thereof starting to ride on the obliquely crossing winding part PR across a progressively riding region thereof partially superposing on the obliquely crossing part PR, and descending on the third layer of obliquely crossing winding part at an extended end thereof. Further, the last winding part turns, at the extended end, to follow a side edge PE4 of the first winding part at the first row of fourth layer and to form the first winding part at the second row of the fourth layer.

Similarly, the ride-over region PX4, of the riding and obliquely crossing winding part PRM3, which is situated just before a position where the part PRM3 completes the oblique crossing over the progressively riding transverse winding part PYM3, proceeds to ride on to reach substantially as high as fifth layer. More specifically, the ride-over region PX4, of the riding and obliquely crossing winding part PRM3, superposing on the progressively riding transverse winding part PYM3 riding on the obliquely crossing winding part PR is situated higher than the fourth layer and reaches substantially as high as fifth layer. On the other hand, a site, of the riding and obliquely crossing winding part PRM3, having descended on the lower layer PL3 is situated at the fourth layer. Therefore, a protrusion PH protruding in the outward direction PJ in view of the cross-section PV is produced at the ride-over region PX4. As shown in the side view of FIG. 23A, an outer surface protrudes outwardly PJ as the protrusion PH4.

The ride-over region PX4 having the protrusion PH4 of the fourth layer is substantially superposed just on the ride-over region PX2 having the protrusion PH2 of the second layer. As a result, ride-over region PX4 protrudes further significantly in the outward direction PJ of the rectangle PS due to the overlapping of the region PX4 on the region PX2.

Therefore, the deviation of the multilayer aligned-winding coil from the rectangle PS becomes more larger. The deviation or distortion due to the protrusion becomes larger as number of layers in the multilayer aligned-winding coil 301 becomes larger, which may leads to a result that the wire of coil 301 cannot be wound in an aligned manner. Alternatively the space factor may be reduced due to reduction in the density of the winding wire or the predetermined turn of multilayer aligned-winding coil cannot be produced to be disposed within a limited cross-sectional area, even in a case where corruption of the multilayer aligned-winding coil 301 or the disabling of the aligned-winding can be avoided.

SUMMARY OF THE INVENTION

The invention has been made in view of the foregoing, and an object of the invention is to provide a multilayer aligned-winding coil in which the wire of wide width can be wound in alignment in the form of multilayer stably and at a high space factor.

The above-mentioned object can be accomplished according to the invention by a multilayer aligned-winding coil, formed by winding, in alignment, a wire of wide width in the form of a multilayer tube, the coil comprising following three features 1, 2 and 3;

<Features 1> each layer having an obliquely crossing winding part extending obliquely with respect to a direction, which extends along a cross-section of the tube substantially perpendicular to a longitudinal axis thereof, in one continuous partial angular region of a virtual endless ring defined by the cross-section of the tube, and a transverse winding part extending transversely along the cross-section in an other partial angular region of the virtual endless ring, <Features 2> said multilayer aligned-winding coil including a plural pairs of consecutively superposed two layers meeting below-mentioned two conditions (1) and (2), (1) a first row of winding portion including a first transverse winding part having a progressively riding transverse winding part riding progressively on a last row of the obliquely crossing winding part of a lower layer of said two layers to reach from the lower layer to an upper layer situated thereover by one layer, and (2) a second row of winding portion including a riding and obliquely crossing winding part extending to obliquely cross from a riding start region, of sad progressively riding traverse winding part, where the riding thereof on the obliquely crossing winding part is started, across a progressive riding region of sad progressively riding traverse winding part superposing at least partially on the obliquely crossing winding part, and descending at an extended end on the obliquely crossing winding part of the lower layer, and <Features 3> said multilayer aligned-winding coil further comprising at least two pairs of said two layers among said plural pairs of said two layers including the riding and obliquely crossing winding parts of the second rows of winding portions having ride-over region parts obliquely riding over the progressively riding regions of the progressively riding traverse winding parts at mutually different angular regions of the endless ring.

In the multilayer aligned-winding coil of the invention, because of the provision of the above-mentioned features 1 and 2, a high space factor can be accomplished under the condition where the gap between the layers is minimized. In addition, in the tubular multilayer aligned-winding coil of the invention, although, because of the provision of the above-mentioned features 1 and 2, the ride-over region part, of the riding and obliquely crossing winding part which extends to obliquely cross from the riding start region, of the progressively riding traverse winding part, where the riding thereof on the obliquely crossing winding part is started across the progressive riding region of the progressively riding traverse winding part superposing at least partially on the obliquely crossing winding part, and descends at the extended end on the obliquely crossing winding part of the lower layer, obliquely crossing the progressively riding region of the progressively riding transverse winding part becomes a protrusion protruding outwards, the protrusions at the ride-over region parts can be distributed at different angular regions thereby enabling to avoid the overlapping of the protrusions only at a specific or limited region, because of the further provision of the features 3, "at least two pairs of said two layers among said plural pairs of said two layers including the riding and obliquely crossing winding parts of the second rows of winding portions having ride-over region parts obliquely riding over the progressively riding regions of the progressively riding traverse winding parts at mutually different angular regions of the endless ring". Therefore, there is little possibility that the arrangement of the coil in a limited space is prevented due to concentration of the protrusions only at the specific regions or positions of the coil and a predetermined performance of coil can be disposed while utilizing a space at maximized efficiency even though the space is limited. In addition, there is little possibility that the aligned-winding is prevented due to the concentration of the protrusion at the specific regions of the coil. As a result, it is ensured that the multilayer aligned-winding coil can be produced without fail. Therefore, in total, multilayer aligned-winding coil can be produced at an enhanced space factor.

It is because the winding wire is in the form of a wire of wide width that the protrusion is formed at the ride-over region and that the formation of the protrusion can be avoided at regions other than the ride-over region. Herein, the wire of wide width is, as defined in the introductory part of the description, the wire having the width greater than the thickness and having a substantially constant thickness region at the widthwise central part thereof. It should be noted that the distribution or spreading of the protrusion described herein cannot be made in a case where the winding wire is a so-called "round wire" having a circular cross-section, because a small protrusion is produced at every position where the round wire portions crosses each other in such wire lacking of "the constant thickness region at the widthwise central part". The magnitude of protrusion in a case where the round wire crosses and rides over to the aligned round wires at a layer thereunder relative to a position or height in a case where the round wire takes an ordinary aligned state where the round wire lies in a recessed region between the two alinged round wires at the lower layer is in the order of $(2\text{-}3^{1/2})$ of the radius of the round wire, which is smaller than the protrusion, in case of the wire of wide width, as large as the thickness of the wire.

The wire of wide width is typically a rectangular wire. The rectangular wire is ideally or typically a wire having a rectangular cross-section. The wire of wide width may have an oval cross-section in which short sides in the cross-section is more or less outwardly convexed. The side edges of the rectangular wire may be more or less meandering although ideally parallel with the longitudinal axis of the wire.

In al multilayer aligned-winding coil according to a typical embodiment of the invention, an inclination of an obliquely crossing winding part, of a lower layer of a pair of the two layers upper than a lowermost pair of the two layers among said at least two pairs of the two layers, with respect to the cross-section is smaller than an inclination of an obliquely crossing winding part, of a lower layer of the lowermost pair of the two layers among said at least two pairs of the two layers, with respect to the cross-section.

The obliquely crossing winding part, an inclination of which with respect to the cross-section is small, may be also referred to hereinafter as a "quasi-obliquely crossing winding part". The quasi-obliquely crossing winding part is formed to produce the progressively riding transverse winding part and the riding and obliquely crossing riding part at an angular region different from that of the lower layer in terms of the angular region of the endless ring. More specifically, the formation of the quasi-obliquely crossing winding part at the different angular region enables to distribute the protrusions while minimizing the reduction in the space factor. The formation of the quasi-obliquely crossing winding part at the different angular region reduces number of turns of the winding wire to some extent on one hand, and enables to have a stable aligned-winding while minimizing the reduction in the space factor on the other hand, which as a whole enables to enhance the number of turns of the coil occupying a predetermined shape or configuration of volume region.

In a multilayer aligned-winding coil according to a typical embodiment of the invention, the ride-over region parts of the riding and obliquely crossing winding parts of the second row of winding portions of three or more pairs of the two layers among the plural pairs of the two layers are situated at a mutually different angular regions of the endless ring.

Such being the case, the protrusions can be distributed over three or more angular regions, which facilitates to prevent only one angular region of the coil from being excessively protruded, and to produce the aligned-winding of the coil thereby enabling to minimize the reduction in the space factor.

In a multilayer aligned-winding coil according to another typical embodiment of the invention, the ride-over region parts of the riding and obliquely crossing winding parts of the second rows of winding portions of at least two consecutive pairs of the two layers among the plural pairs of the two layers are situated in the same angular region of the endless ring.

For example, in a case where the cross-section of the coil comprises a long side and a small side (including a curved part) such as a rectangle or an oval, the ride-over regions are concentrated on the long side owing to ease of arrangement so long as the coil allocation region is not specifically limited.

In a multilayer aligned-winding coil according to one typical embodiment of the invention, the ride-over region parts of the riding and obliquely crossing winding parts of the second rows of winding portions of two consecutive pairs of the two layers among the plural pairs of the two layers are situated in the same angular region of the endless ring.

In this case, it is possible to minimize the reduction in the space factor. More specifically, the distribution of the ride-over region parts at different angular regions unavoidably involves more or less reduction in the space factor. There is not a few cases that it is preferred the same angular region is used for the ride-over region parts to maximize the space factor and number of turns within an allowable degree of distortion in an outer shape of the coil and within a level enabling to avoid the excessive protruding of the protrusions due to the superposition of the ride-over regions leading to disable the aligned-winding. As a matter of course, the ride-over regions are partially distributed to different angular regions to avoid the difficulties in the aligned-winding and the excessive distortion in the outer shape of the coil.

In a multilayer aligned-winding coil according to one typical embodiment of the invention, the endless ring has plural curvature parts of different curvatures, at least one of the ride-over region parts of the plural riding and obliquely crossing winding parts is a small curvature part, having a small curvature among the different curvatures of the plural curvature parts, such as a long side of the rectangle or oval in case of the coil having a cross-sectional shape in the form of the rectangle or oval. The curvature of the small curvature part may be substantially zero.

In this case, it is easy to arrange the ride-over region part and there is relatively little possibility that the protrusion of the protruding part may affect the outer shape of the coil and that it may become difficult to wind the wire in aligned manner.

However, in a tubular multilayer aligned-winding coil according to one typical embodiment of the invention, the endless ring has plural curvature parts of different curvatures, at least one of the ride-over region parts of the plural riding and obliquely crossing winding parts may be a large curvature part having a large curvature among the different curvatures of the plural curvature parts, if desired.

In a multilayer aligned-winding coil according to an embodiment of the invention, the endless ring is substantially rectangular or oval. However, the shape of the endless ring, i.e. the shape of the cross-section of the coil, may be square or triangle or circular. The corner is typically made more or less smoothly curved when the endless ring is triangle or polygonal.

In a multilayer aligned-winding coil according to one typical embodiment of the invention, the second row of winding portion comprises a second transverse winding part turning at the extended end of the riding and obliquely crossing winding part to extend along a side edge, at a side of the second row in the transverse direction over the obliquely crossing winding part constituting the lower layer.

In this case, multilayer aligned-winding coil can be produced by winding the wire for the coil in the similar pattern.

BRIEF DESCRIPTION OF THE DRAWINGS

The foregoing and other objects as well as features of the invention will be made clearer from the description of preferred embodiments of the invention hereafter with reference to accompanying drawings in which, FIGS. 1A to 1D are explanatory views for illustrating a process of producing a rectangular wire multilayer aligned-winding rectangular coil as a multilayer aligned-winding coil according to one preferred embodiment of the invention, in which FIGS. 1A, 1B, 1C and 1D are oblique views showing several initial steps or stages;

FIGS. 2A to 2D are explanatory views for illustrating the process of producing the rectangular wire multilayer aligned-winding rectangular coil as the multilayer aligned-winding coil according to one preferred embodiment of the invention, in which FIGS. 2A, 2B, 2C and 2D are oblique views showing several steps or stages following the steps or stages of FIGS. 1A to 1D;

FIGS. 3A to 3D are explanatory views for illustrating the process of producing the rectangular wire multilayer aligned-winding rectangular coil as the multilayer aligned-winding coil according to one preferred embodiment of the invention, in which FIGS. 3A, 3B, 3C and 3D are oblique views showing several steps or stages following the steps or stages of FIGS. 2A to 2D;

FIGS. 4A to 4B are enlarged views of the coil shown in the winding state of FIG. 1D, in which FIG. 4A is a side view of FIG. 4B, and FIG. 4B is an enlarged oblique view of FIG. 1D;

FIGS. 5A to 5B are explanatory views illustrating parts of the process of FIGS. 2A to 2D, more in detail, among the process of producing the rectangular wire multilayer aligned-winding rectangular coil as the multilayer aligned-winding coil according to one preferred embodiment of the invention, in which FIGS. 5A and 5B are oblique views showing states between those of FIG. 2C and FIG. 2D;

FIGS. 6A to 6B are enlarged views of the coil shown in the winding state of FIG. 3C, in which FIG. 6A is a side view of FIG. 6B and corresponds to an enlarged view of FIG. 3D, and FIG. 6B is an enlarged oblique view of FIG. 3C;

FIGS. 7A to 7B illustrates situations where the protrusions are formed in the multilayer aligned-winding coil according to one preferred embodiment of the invention, in which FIG. 7A is an explanatory plan view showing the situation where the protrusion H2 is formed—small width portions at both sides of each winding wire correspond to rounded side edges, in view of the cross-section shown in FIGS. 10C and 10E, where thickness of the wire is progressively changed, and FIG. 7B is an explanatory plan view showing the situation where the protrusion H4 is formed, while illustration of the side edges having the gradually changing thickness shown in FIG. 7A is omitted in FIG. 7B;

FIGS. 8A to 8F illustrate several the multilayer aligned-winding coils according to preferred embodiments of the invention, in which FIG. 8A is a side view of the coil which is wound up to fourth layer and has protrusions at a slightly deviated or different angular positions of the same side, FIG. 8B is a diagrammatic side view showing the protrusions of FIG. 8A diagrammatically, and FIGS. 8C to 8F show diagrammatically the positions of the protrusions in the same way as FIG. 8B, in which FIG. 8C is a side view of the multilayer aligned-winding coil where the protrusions are distributed at the two different angular regions, FIG. 8D is a side view of the multilayer aligned-winding coil where the protrusions are distributed at two different angular regions one of which is the short side of the rectangle, FIG. 8E is a side view of the multilayer aligned-winding coil where the protrusions are distributed at four different angular regions, and FIG. 8F is a side view of the multilayer aligned-winding coil where the protrusions are distributed at two different angular regions, two consecutive protrusions of one of the two angular regions being formed at the same angular region;

FIGS. 9A to 9F illustrate other several the multilayer aligned-winding coils according to preferred embodiments of the invention in the same manner as to FIGS. 8B to 8F, in which FIGS. 9A, 9B, 9C, 9D, 9E and 9F are diagrammatic side views of various modifications;

FIGS. 10A to 10F show rectangular wires as the wire of wide width, in which FIGS. 10A and 10B are respectively an explanatory cross-sectional view of an ideal rectangular wire and an explanatory plan view of thereof, FIGS. 10C and 10D are respectively an explanatory cross-sectional view of a rectangular wire having an oval cross-sectional shape and an explanatory plan view of thereof having side edges slightly different from the linear shape, FIGS. 10E and 10F are respectively an explanatory cross-sectional view of a rectangular wire having a distorted oval cross-sectional shape and an explanatory plan view of thereof having meandered side edges;

FIGS. 11A to 11C show diagrammatically a few multilayer aligned-winding coils according to preferred embodiments of the invention, in which FIG. 11A is a diagrammatic view of the multilayer aligned-winding coil having a circular cross-section, FIG. 11B is a diagrammatic view of the multilayer aligned-winding coil having a triangle cross-section, and FIG. 11C is a diagrammatic view of the multilayer aligned-winding coil having an oval cross-section;

FIGS. 12A to 12B show a position control mechanism having a multilayer aligned-winding coil according to an embodiment of the invention, in which FIG. 12A is a cross-sectional view of FIG. 12B along a line XIIA-XIIA, and FIG. 12B is a side view of FIG. 12A;

FIGS. 13A to 13C show an other position control mechanism having a multilayer aligned-winding coil according to an embodiment of the invention, in which FIG. 13A is a cross-sectional view of FIG. 13B along a line XIIIA-XIIIA therein, FIG. 13B is a front view of FIG. 13A, and FIG. 13C is a cross-sectional view of FIG. 13B along a line XIIIC-XIIIC therein;

FIG. 16B is a view shown along an arrowed line XVIB-XVIB of FIG. 16A, and FIG. 16C is a side view showing a state upon winding;

FIGS. 17A to 17C show a process of forming a conventional rectangular wire multilayer aligned-winding coil, in which FIGS. 17A, 17B and 17C are oblique views illustrating three stages thereof;

FIGS. 18A to 18C show a process of forming another conventional rectangular wire multilayer aligned-winding coil, in which FIGS. 18A, 18B and 18C are oblique views illustrating three stages thereof;

FIGS. 19A to 19H show a process of forming still another conventional rectangular wire multilayer aligned-winding coil, in which FIGS. 19A, 19B, 19C, 19D, 19E, 19F, 19G and 19H are oblique views illustrating eight stages thereof;

FIGS. 20A to 20B show a part of FIGS. 19A to 19H in the form of enlarged views, in which FIG. 20A is an enlarged view of FIG. 19C, and FIG. 20B is an enlarged view of FIG. 19D;

FIG. 21A to 21B are illustrations for explaining the state of FIG. 19D, in which FIG. 21A is a side view of FIG. 21B, and FIG. 21B is an oblique view shown at an angle different from FIG. 21A and is arranged in side by side relationship with FIG. 21A for comparison with FIG. 21A although the same as FIG. 20B;

FIGS. 22A to 22B show a part of FIGS. 19A to 19H in the form of enlarged views, in which FIG. 22A is an enlarged view of FIG. 19G, and FIG. 22B is an enlarged view of FIG. 19H;

FIG. 23A to 23B are illustrations for explaining the state of FIG. 19H, in which FIG. 23A is a side view of FIG. 23B, and FIG. 23B is an oblique view shown at an angle different from FIG. 23A and is arranged in side by side relationship with FIG. 23A for comparison with FIG. 23A although the same as FIG. 22B.

DETAILED DESCRIPTION OF THE PREFERRED EMBODIMENTS

Now, a multilayer aligned-winding coil according to a preferred embodiment of the invention is explained with reference to FIGS. 1A to 1D, 2A to 2D, 3A to 3D and 4A to 4B.

Figure 12B:
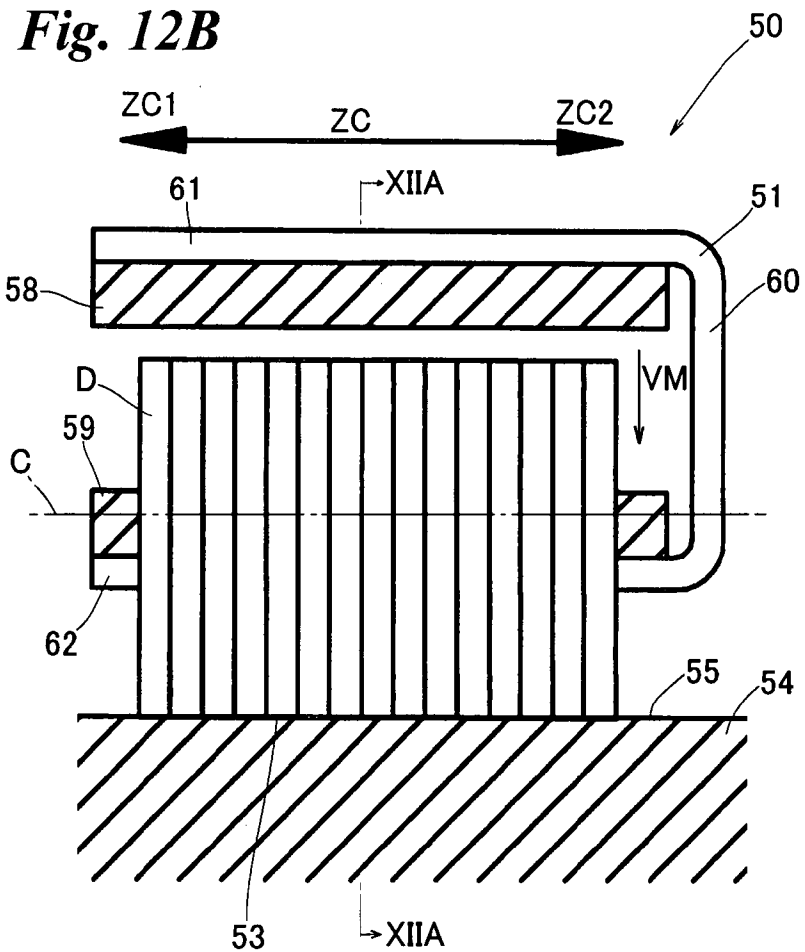
Figure 12A:
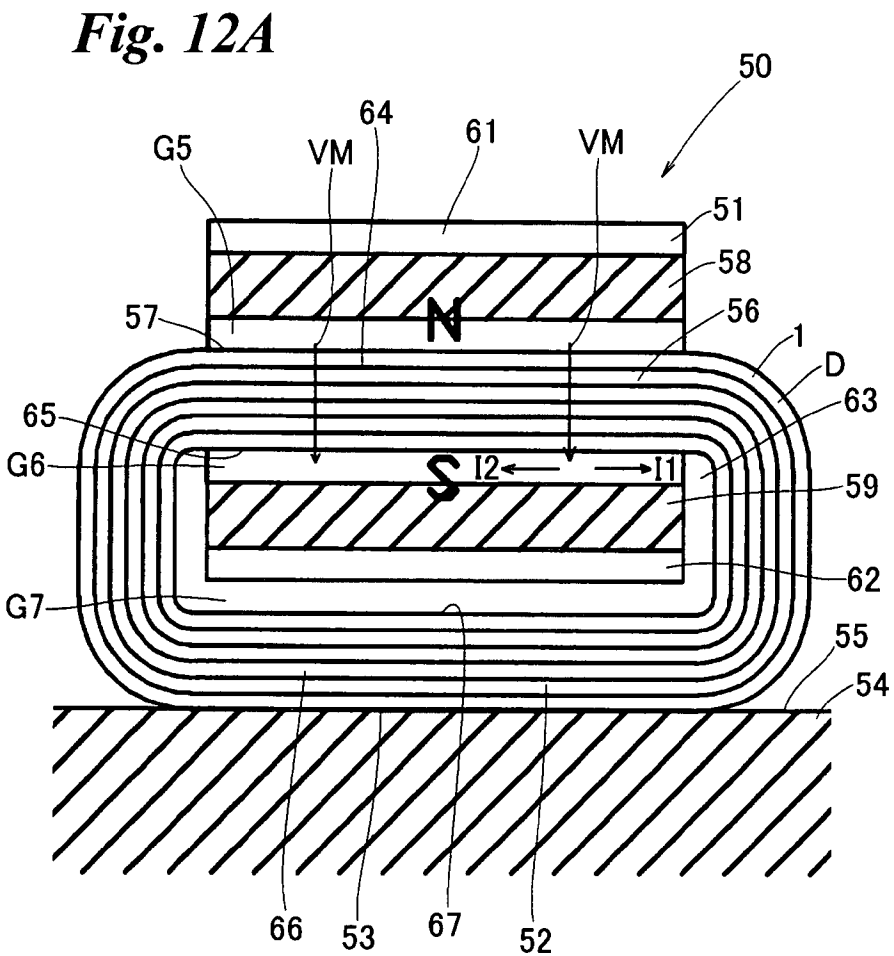

A multilayer aligned-winding rectangular coil 1 according to the multilayer aligned-winding coil has a form or configuration, for example, as shown in FIGS. 8C, 8D, 8E and 8F (differences thereof will be described later) and FIGS. 12A and 12B. The multilayer aligned-winding rectangular tubular coil 1 is formed by winding rectangular wire D as the wire of the wide width in an aligned manner in multiple layers as well as in multiple rows. The multilayer aligned-winding coil 1 shown in FIGS. 12A and 12B is formed by winding rectangular wire D in 6 layers of 5 rows, and therefore the number of turns thereof is 90 turns. More strictly, the number of turns are different depending on the layers in the multilayer aligned-winding coil of the invention as described and illustrated later in detail. The multilayer aligned-winding coil 1 shown in each of FIGS. 8C, 8D, 8E and 8F are formed by 10 layers of winding wire, while number of rows are not illustrated.

Figure 11A:
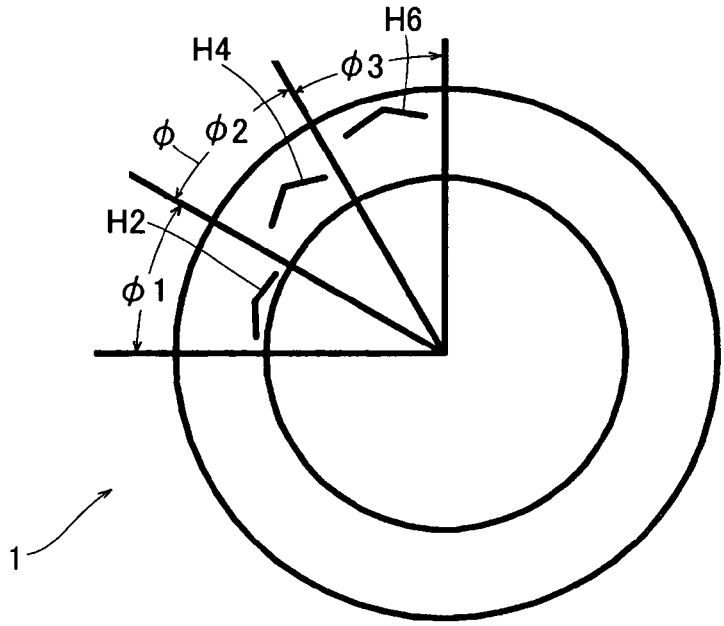
Figure 11B:
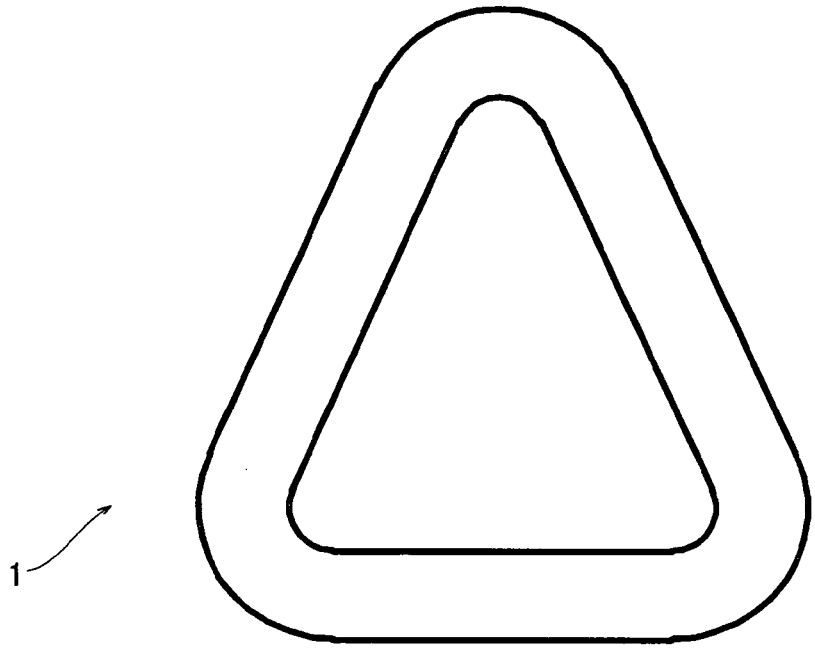
Figure 11C:
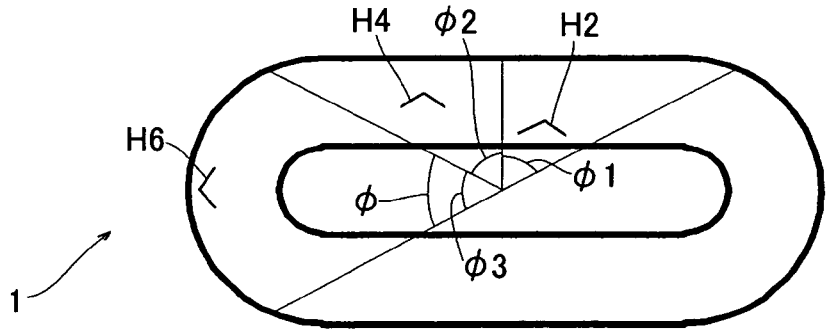

Number of rows in the multilayer aligned-winding coil 1 may be more than or less than 15, and number of layers in the multilayer aligned-winding coil 1 may be more than or less than 6. Although the cross-sectional shape of the multilayer aligned-winding coil 1 is rectangular among square or rectangular in this case, the coil may have other cross-sectional shapes such as circular, triangle or oval shape as shown in FIGS. 11A, 11B and 11C. In the case where the cross-sectional shape of the multilayer aligned-winding coil is triangle or polygonal such as square, the corner corresponding to the apex is formed more or less round so that the wire D can be wound without possibility of being broken to be cut. However, for the conveniences of the illustration and description, it is described hereinafter as being a simple corner unless necessary for explanation.

The term "tubular" in the multilayer aligned-winding coil is referred to as the shape thereof formed by the wire being in the form of a tube or hollow rod. The tube may have the maximum size in the cross-section thereof, i.e. length of so-called major diameter, as long as the length of the tube, or longer than or shorter than it. There may be or may not be something like a support such as the core or bobbin supporting the winding wire. In the case where the support such as the core or bobbin is provided, the support may be hollow or solid. In the case where the core is provided, the core may be made of magnetic or non-magnetic material. The multilayer aligned-winding coil 1 may be or may not be supported at both end faces or one end face thereof by the flange-like supports or support.

Figure 10A:
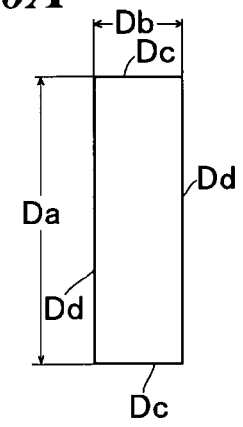

The rectangular wire D constituting the multilayer aligned-winding coil 1 has typically a rectangular cross-sectional shape as shown in FIG. 10A, in which the long (major) side of the rectangle corresponds to a width Da of the wire D and a short or narrow side of the rectangle corresponds to a thickness Db of the wire D. The rectangular wire is made of copper wire covered with insulating coating. However, the wire may be a wire of conductor material other than the copper. The width Da and thickness Db of the rectangular wire D are typically in the order of 0.05-0.2 mm and 0.02-0.05 mm respectively.

Figure 10B:
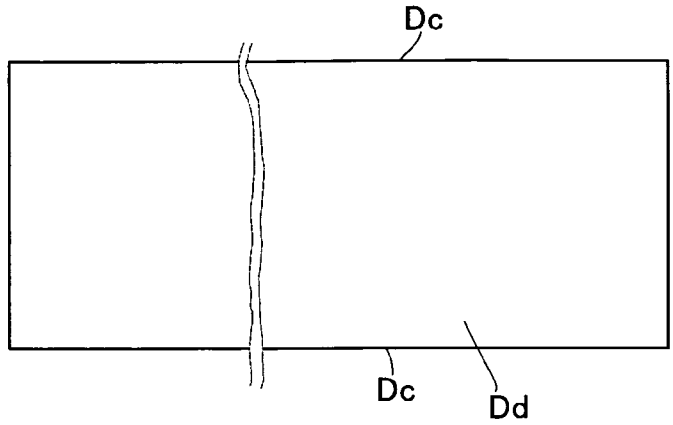
Figure 10C:
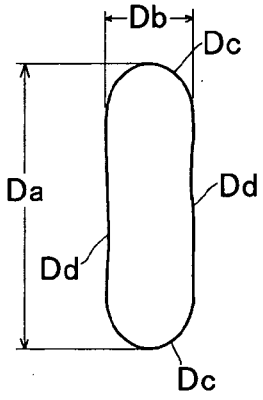
Figure 10D:
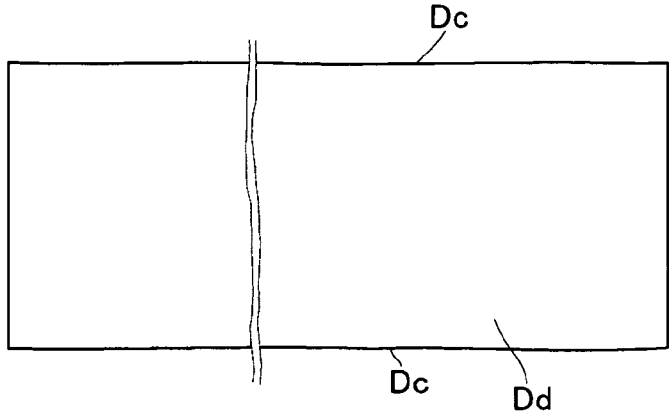
Figure 10E:
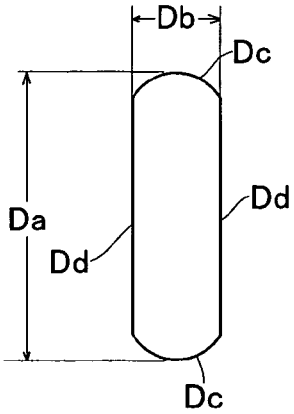
Figure 10F:
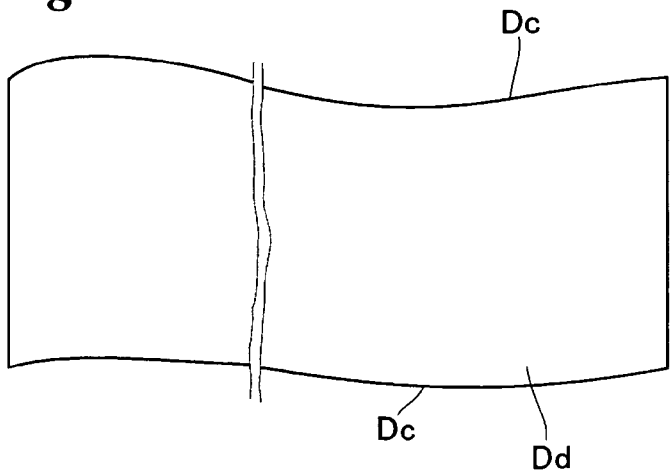

The aspect ratio Da/Db is generally within a range of 2-5, and is typically about 3. However, so long as Da>Db, the width Da may be greater than about 0.2 mm or less than about 0.05 mm, the thickness Db may be greater than about 0.05 mm or less than about 0.02 mm, and the ratio Da/Db may be greater than 5 or less than 2. Hereinafter, description is made assuming that the rectangular wire has an ideal rectangular cross-section unless specifically described otherwise. However, the cross-sectional shape of the actual rectangular wire D is in most cases oval with either widthwise end Dc, Dc more or less rounded as shown in FIG. 10C or 10E rather than the ideal rectangle as shown in FIG. 10A. The side edge Dc is shown as semi-circular or similar thereto herein, but may have more or less more distorted or irregular shape. The side edge Dc of the actual rectangular wire D is more or less deviated from being linear to be meandered to have a not constant but varying width as shown in FIG. 10D or as exaggeratedly shown in FIG. 10F rather than being ideally linear to have a constant width as shown in FIG. 10B. In addition, two principal faces Dd, Dd of wide width constituting the rectangular wire D may have uneven face as shown in FIG. 10C rather than the ideally planar as shown in FIG. 10A, even in the case where the center of the rectangular wire D extends linearly. As shown in FIG. 1E, the principal face Dd may be in the form of a face produced by linearly cutting the circular side edge Dc. Thus, the rectangular wire D herein is intended to include the thus-described wire of more or less distorted shape.

As described above, strictly speaking, the side edges of the adjacent rows of wire portions are not closely contacted with each other but is partially contacted and faced to each other with a narrow gape therebetween because the side edge Dc of the rectangular wire D is more or less meandered, because the width Da itself is more or less varied or because the region around the side edge Dc being curved like the oval arc. More specifically, although it is described hereinafter for the sake of simplicity of explanation that the adjacent winding parts extending on the same layer is closely contacted with each other, there can be some gap between the adjacent winding parts. A magnitude of the gap is typically equal to or less than a few % of the width Da of the winding wire D.

Now, an embodiment of forming a rectangular tubular multilayer aligned-winding coil by a rectangular wire D is described with reference to FIGS. 1A to 1D, 2A to 2D and 3A to 3D. In FIGS. 1A to 1D, 2A to 2D and 3A to 3D, the multilayer aligned-winding coil 1 is assumed to have four rows for the sake of simplicity of explanation. In addition, the process for winding or superposing the multilayer aligned-winding coil up to a part of the of fourth layer will be described in detail. Description of further stack of layers is omitted to avoid repetition.

Figure 1A:
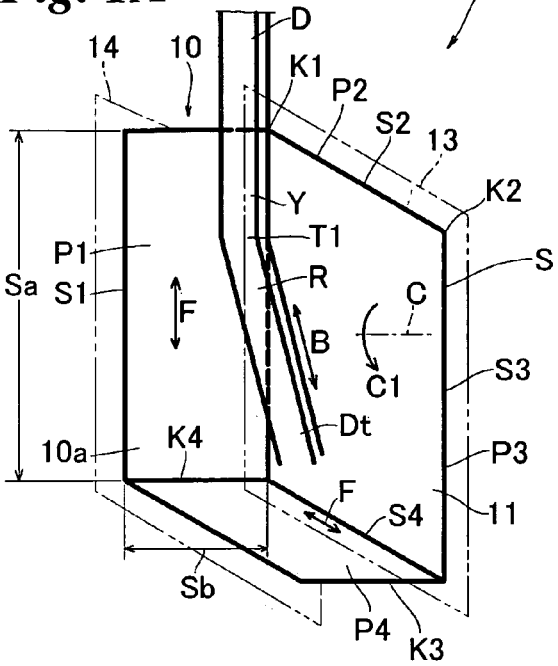

The wire D of the multilayer aligned-winding coil 1 is assumed to be wound around a virtual winding core body 10*a* as shown in FIG. 1A. The winding core 10*a* is in the form of rectangular parallelepiped, a cross-section of which is square. More specifically, the cross-section of the winding core body 10*a* has four sides S1, S2, S3 and S4 which form an endless ring S in the form of a square. A length of each side of the square endless ring S is Sa. A length of the winding core body 10*a* is Sb, which is slightly longer than an integral multiple (corresponding to the maximum number of turns per layer or number or rows) of the width Da of the wire D. A central axis passing through the center of gravity of square cross-section S of the winding core 10*a* and perpendicular thereto is denoted by "C". The central axis C coincides with the central axis C of the multilayer aligned-winding coil 1. The corners corresponding to apexes of the square S is denoted by K1, K2, K3 and K4. The corners K1, K2, K3 and K4 are actually formed roundly.

There is a flange-like support face 13 extending outward at one end face 11 of the winding core body 10*a* along substantially the same plane as the end face 11 as shown an imaginary line 13. There is a flange-like support face 14 extending outward at another end face 12 of the winding core body 10*a* in parallel with the end face 12. Side faces corresponding to the sides S1, S2, S3 and S4 of the winding core 10 are shown respectively by reference symbols P1, P2, P3 and P4.

A part, of the winding wire portion of the rectangular wire D, extending in a plane (parallel with the end faces 11, 12) perpendicular to the central axis C, that is a part extending in the transverse direction F, is referred hereinafter to as a transverse winding part Y. Similarly, a part, of the winding wire portion of the rectangular wire D, extending in an oblique direction or crossing direction B with respect to the plane (parallel with the end faces 11, 12) perpendicular to the central axis C is referred to as an obliquely crossing winding part R. The transverse winding part Y is a winding part extending in a specified row and the obliquely crossing winding part R is a winding part transiting or traversing from a row to an other row adjacent thereto. A part of the winding portion transiting from a layer of the multilayer aligned-winding coil 1 to a layer thereabove is referred to as a riding winding part, which is denoted by a reference symbol M (see FIG. 1C etc.). The riding winding part M is a winding part transiting from a layer of the multilayer aligned-winding coil to a layer thereabove.

In the explanation hereafter, each winding part of the multilayer aligned-winding coil 1 is denoted by L(i; j; k) where i=1, 2, 3, 4; j=1, 2, 3, 4; and k=1, 2, 3, 4 in an embodiment of FIGS. 1A to 1D, FIGS. 2A to 2D, and FIGS. 3A to 3D. However, the above-mentioned expression L(i; j; k) of the multilayer aligned-winding coil 1 is not described in the drawings for the sake of simplicity. Herein, "i" denotes a layer (for example, i=1 corresponds to the first layer (lowermost or lowest layer), "j" denotes a row (for example, j=1 corresponds to the first row that is the right end row at a side of the end face 11 in the odd number of layer, and that is the left end row at a side of the end face 12 in the even number of layer, and j=4 corresponds to the last row), and "k" corresponds to the four sides (k=1 corresponds to the first side. In a case where it is necessary to denote a winding wire part, in the multilayer aligned-winding coil 1, involving the transition of the row and/or the transition of the layer, i.e. the obliquely crossing winding part R or the riding winding part M, the winding wire part of the multilayer aligned-winding coil 1 is denoted by L(i1, i2; j1, j2; k1, k2), where "j1" denotes a row of the start point of the obliquely crossing winding part R, and "j2" denotes a row of the end point of the obliquely crossing winding part R, while k1=k and "k2" is 5 for the obliquely crossing winding part R and 6 for the transverse winding part F. In addition, "i1" denotes a layer before the riding and "i2" denotes a layer after the riding. In the winding wire part where the riding does not happen, it is not necessary to distinguish "i1" from "i2", and both are commonly denoted by "i" and by L(i; j1, j2; k1, k2) as well. Similarly, when only the transverse winding part F is referred to, there is no transition of row, and therefore "j1" and "j2" are not distinguished but is denoted simply by L (i1, i2; j; k1. k2), L (i1, i2; j; k), L (i; j; k1, k2) or L (i; j; k).

Now, formation or production of the multilayer aligned-winding coil 1 by the winding of the rectangular wire D around the winding core 10 is explained in detail. However, the winding machine enabling to form the multilayer aligned-winding coil 1 is described separately later in detail.

Figure 16B:
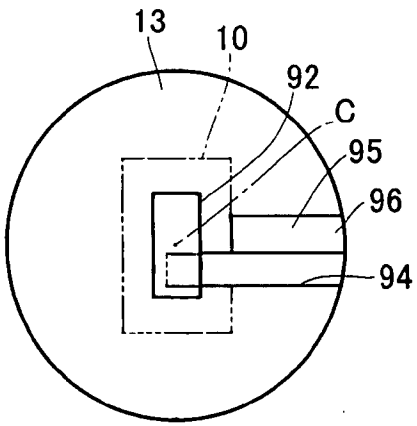
FIGS. 16A, 16B and 16C show the winding core portion of the coil winding machine, in which FIG. 16A a side view showing a state upon initially mounting the winding wire.

At first, as shown in FIG. 1A, a distal end Dt of the rectangular wire D is clamped along an oblique direction B relative to the end face 11 of the winding core 10 by means of a clamping portion (not shown) at an outside (right-hand side of FIG. 1A) of the flange-like support face 13 (FIG. 16B etc to be explained later). Then the direction of the rectangular wire D is changed to extend along the flange-like support face 13 at an intermediate position of the side face P1 corresponding to the first side S1. Thereby, on the first side face P1 (first side S1) at the first row of the first layer, the obliquely crossing winding part R and the transverse winding part Y are formed, and a turning point or direction-changing point T (T1 herein) is formed at a boundary between the obliquely crossing winding part R and the transverse winding part Y. According to the above-mentioned expression, the obliquely crossing part R is expressed, for example, by L (1; 0, 1; 1, 5) and the transverse winding part Y is expressed, for example, by L (1; 1; 1, 6) or L (1; 1; 1).

Figure 1B:
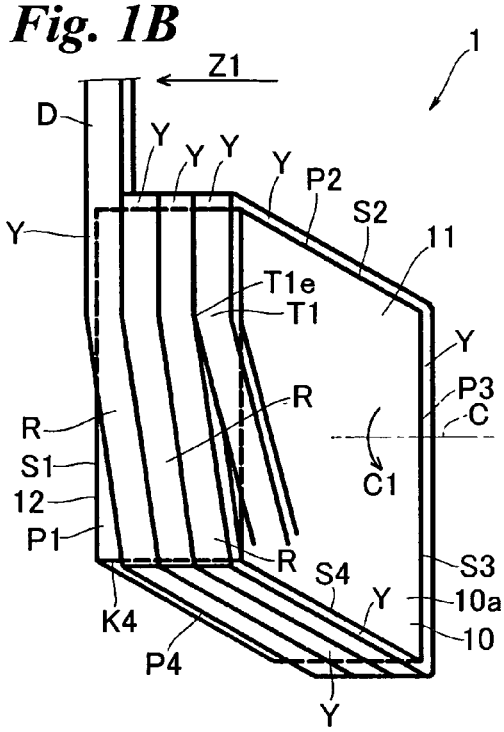

Then, as shown in FIG. 1B, the rectangular wire D is wound along the other sides S2, S3 and S4, or side faces P2, P3 and P4, of the endless ring S of the winding core 10. Thereby, the first row of transverse winding parts Y, Y and Y are formed at the side faces P2, P3 and P4. Each of the transverse winding parts Y, Y and Y are expressed, for example, by L (1; 1; 2), L (1; 1; 3) and L (1; 1; 4).

In the winding of the rectangular wire D as described above, the winding core 10 is actually rotated in the direction C1 around the central axis C thereof. However, a way of winding the rectangular wire D is shown and described mainly in a coordinate where the winding core 10 is fixed, so as to describe how the rectangular wire D is wound.

Then, returning back to the side S1 or side face P1, the obliquely crossing winding part R or L (1; 1, 2; 1, 5) is formed to extend from the corner K4 of the first row to an outer side edge T1*e* of the turning point T1. The wire D is further turned along the outer side edge T1*e* of the turning point T1 to form a transverse winding part Y or L (1; 2; 1, 6) which extends in substantial contact with and parallel with a side edge, on a side of the next or second row, of the first row transverse winding part Y on the side face P1.

Further, in the same manner as that mentioned above, the second row of transverse winding parts Y, Y and Y are formed on the side faces P2, P3 and P4, while the second row of transverse winding parts Y and Y on the side faces P2 and P3 are not shown in FIG. 1B. In the description hereinafter, a part or parts not shown in the drawing(s) is or are also described in the same manner. Then, the obliquely crossing winding part R (L (1; 2, 3; 1, 5)) extending from the second row to the third row and the transverse winding part Y (L (1; 3; 1, 6)) at the third row are formed similarly on the side face P1. Similarly, the third row of the transverse winding parts Y, Y and Y are formed on the side faces P2, P3 and P4, and the obliquely crossing winding part R (L (1; 3, 4; 1, 5)) extending from the third row to the fourth row and the transverse winding part Y (L (1; 4; 1, 6)) at the fourth row are formed similarly on the side face P1. Herein, the left-hand side edge of transverse winding part Y at the fourth row lies in the same plane as the end face 12 of the winding core 10*a*. In other words, the length Sb of the winding core 10*a* is substantially the same as a width 4Db of four winding wires D.

Then, the fourth row of the transverse winding parts Y, Y and Y are formed on the sides P2, P3 and P4.

Figure 1C:
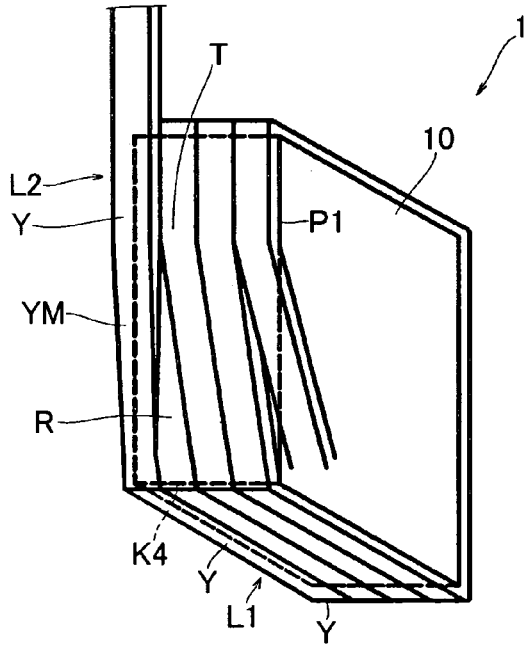

Then, as shown in FIG. 1C, the transverse winding part Y is formed all over the side face P1 from the corner K4. The winding part Y comprises a progressively riding transverse winding part YM (L (1, 2; 4; 1)) which lies in the first layer at the corner K4 and then progressively ride on the obliquely crossing winding part R (L (1; 3, 4; 1, 5)) to reach an area on the turning point T, and a transverse winding part Y (L (2; 1; 1, 6)) at the first row of the second layer extending transversely superposing on the transverse winding part Y (L (1; 4; 1, 6)) at the fourth row of the first layer. A part of the second layer L2 superposing on the fourth row (last row) of the first layer L1 is the first row (initial row).

Figure 8A:
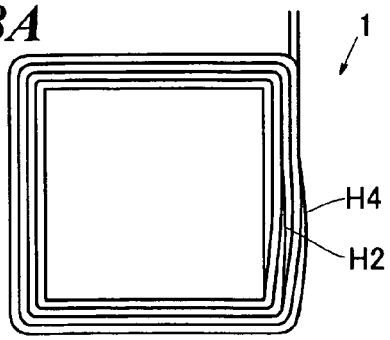

In FIGS. 1A to 1D, 2A to 2D and 3A to 3D, the corners K1, K2, K3 and K4 are shown as if they are at a right angle. However, the corners K1, K2, K3 and K4 are actually rounded like a circular arc so as to avoid excessive bending of the winding wire D as shown in FIG. 8A for the multilayer aligned-winding coil 1. The circular arc has, for example, a radius of curvature of approximately 0.3 to 0.5 mm. The length Sb of the body 10*a* of the winding core 10 is a slightly greater than the integral multiple (number of rows) of the width Db of the winding wire D, and therefore, the progressively riding and transverse winding part YM (L (1, 2; 4; 1)) can be wound around the winding core 10 in such a manner that the left side edge thereof extends along the flange-like support face 14. Accordingly, the winding wire D progressively rides on the obliquely crossing winding part R (L (1; 3, 4; 1, 5)) after turning around the rounded corner K4. In other words, a portion, of the progressively riding and transverse winding part YM (L (1, 2; 4; 1)), having just completed to turn around the rounded corner K4 lies typically at the first layer or at a height position to be regarded as being at the first layer, and that the riding onto the obliquely crossing winding part R (L (1; 3, 4; 1, 5)) is not started substantially.

The rectangular wire D has ideally a cross-section in the form of rectangle as shown in FIG. 10A. However, in the actual rectangular wire having been formed by rolling the round wire (wire having a substantially circular cross-section) to change into flattened form (in the form of wire of wide width), the cross-sectional shape thereof is typically oval or similar thereto as shown in FIG. 10C or 10E. Therefore, the widthwise edge or side edge Dc of the rectangular wire D has an outer face which is more or less curved like the circular arc, and the thickness thereof becomes thinner as closer to the widthwise ends Dc, Dc. Therefore, in a case where the progressively riding transverse winding part YM is riding onto the obliquely crossing winding part R (L (1; 3, 4; 1, 5)), the progressively riding transverse winding part YM does not readily rise from the first layer to the second layer just after start of the riding, but it rises progressively from the first layer to the second layer because the circular arcuate side edge Dc of the progressively riding transverse winding part YM progressively ride onto the circular arcuate side edge Dc of the obliquely crossing winding part R (L (1; 3, 4; 1, 5)). However, the rectangular wire D may have an ideally rectangular cross-sectional shape as shown in FIG. 10A. Such being the case, the progressively riding transverse winding part YM rises, as a whole, more or less progressively from the first layer to the second layer because the progressively riding transverse winding part YM rides obliquely onto the obliquely crossing winding part R.

Figure 1D:
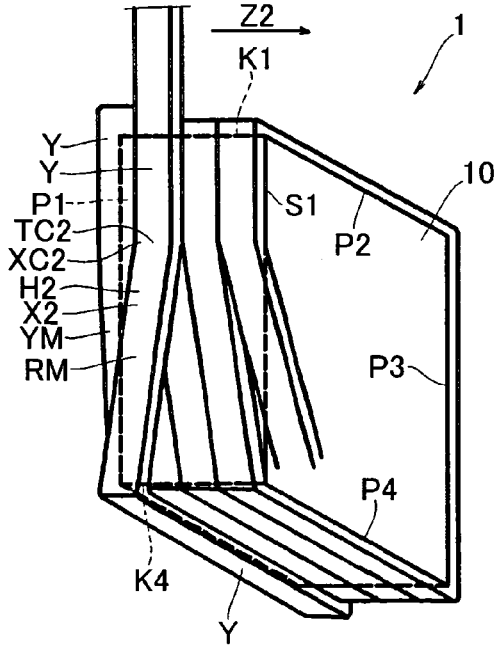

Then, as shown in FIG. 1D etc., the transverse winding parts Y, Y and Y at the first row of the second layer are formed on the side faces P2, P3 and P4 similarly as described above.

Figure 4B:
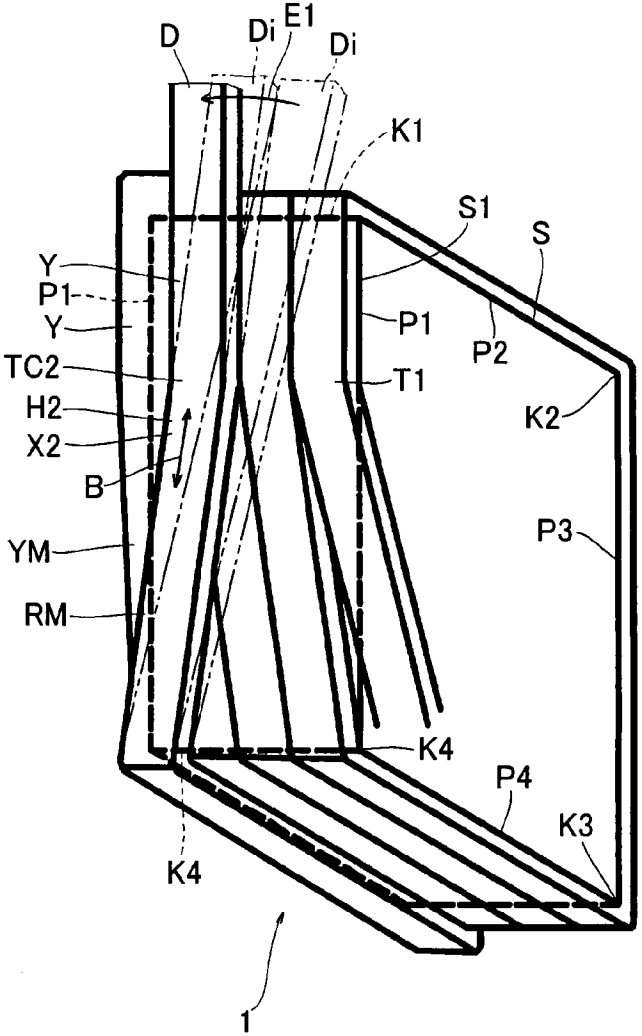

Then, as shown in FIG. 1D and FIG. 4B which is an enlarged view thereof, the wire is further wound around the corner K4 of the first row and returns the side S1 or side face P1 to form a riding and obliquely crossing winding part or progressively riding and obliquely crossing winding part RM (L (2; 1, 2; 1, 5)) extending to cross obliquely over an outer surface of the progressively riding transverse winding part YM (L (1, 2; 4; 1)) to reach near the third turning point T of the first layer and to descend down to the winding part of the first layer L1, and a transverse winding part Y (L (2; 2; 1, 6)) at the second row of the second layer turned at an extended end of the riding and obliquely crossing winding part RM to extend in the transverse direction F on the transverse winding part Y of the first layer along a side edge of the transverse winding part Y (L (2; 1; 1, 6)) of the first row of the second layer.

Herein, the turning point TC2 formed at the boundary between the riding and obliquely crossing winding part RM (L (2; 1, 2; 1, 5)) and the transverse winding part Y (L (2; 2; 1, 6)) is typically situated just above the turning point T of the first layer. However, the turning point TC2 may be situated at a position closer to the corner K4 than the turning point T or at a position closer to the corner K1 than the turning point T.

Upon forming the turning point T, as shown in FIG. 4B, the winding wire D is once pulled to extend in a direction closer to the end face 11 (FIG. 1A) than the extending direction B of the riding and obliquely crossing winding part RM (L (2; 1, 2; 1, 5)) as shown by imaginary lines Di, and the winding wire Di is then swung in the direction E1 under tension to abut a side edge thereof against the side edges of the progressively riding transverse winding part YM (L (1, 2; 4; 1)) and the transverse winding part Y (L (2; 1; 1, 6)) to form the turning point TC2. Upon winding the winding wire D, as described later with reference to FIGS. 14 and 15, an extended portion of the winding wire D is actually swung in the direction E1 by a traverse mechanism 40 (see FIG. 15) while rotating the winding core in the direction C1 or placing at a predetermined rotational position in the direction C1, thereby conducting the above-mentioned turning and producing a desired style of winding wire D.

Figure 7B:
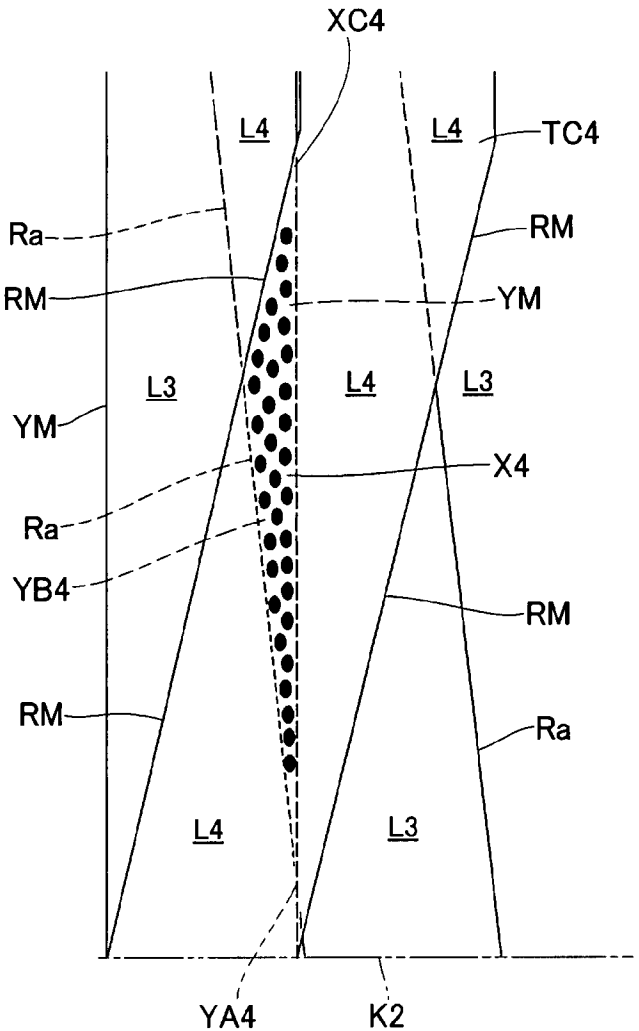
Figure 7A:
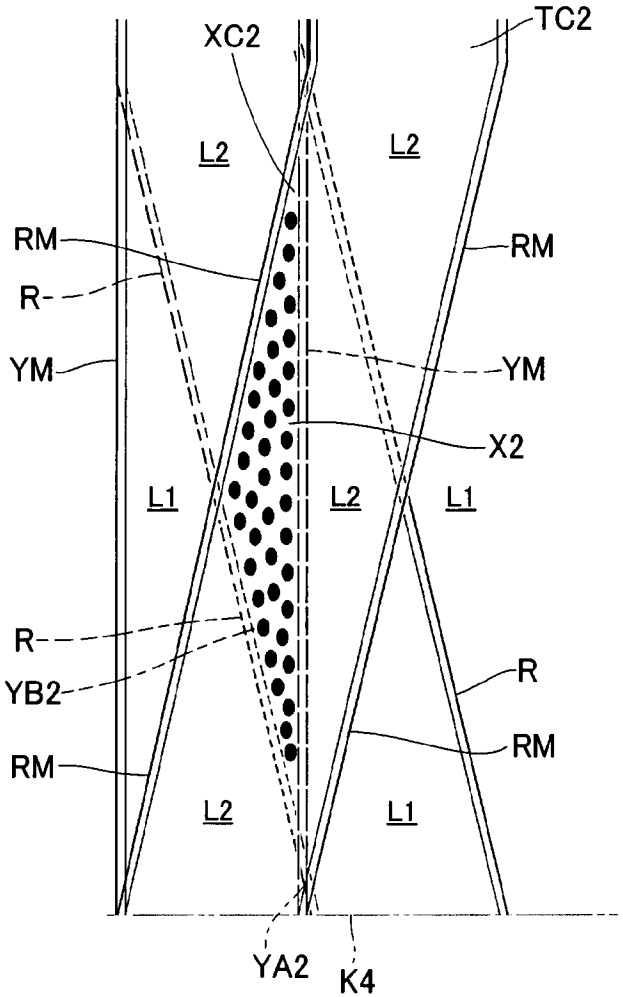

As shown in FIG. 7A which is a partially enlarged explanatory plan view, in the multilayer aligned-winding coil 1 of the rectangular wire D, the riding and obliquely crossing winding part RM (L (2; 1, 2; 1, 5)) extends to cross over obliquely from a riding start region YB2, of the progressively riding transverse winding part YM (L (1, 2; 4; 1)), starting to ride on the obliquely crossing winding part R (L (1; 3, 4; 1, 5)) across a progressively riding region YB2 thereof partially superposing on the obliquely crossing winding part R (L (1; 3, 4; 1, 5)). A portion XC2, of the riding and obliquely crossing winding part RM (L (2; 1, 2; 1, 5)), which completes the oblique crossing of the progressively riding transverse winding part YM (L (1, 2; 4; 1)) is situated substantially at the third layer L3 because of the progress of the progressive riding. More specifically, a region X2, of the riding and obliquely crossing winding part RM (L (2; 1, 2; 1, 5)), superposing on the progressively riding transverse winding part YM (L (1, 2; 4; 1)) having ridden on the obliquely crossing winding part R (L (1; 3, 4; 1, 5)), i.e. the ride-over region X2, filled with black dots "●", reaches a position fairly higher than the second layer L2. On the other hand, a part, of the riding and obliquely crossing winding part RM (L (2; 1, 2; 1, 5)), having descended down onto the first layer (lower layer) L1 is situated at a position as high as the second layer (upper layer) L2. Therefore, as shown in FIG. 4B in addition to FIG. 4A, a protrusion H2 protruding outwards J of the square S in a plane parallel with the cross-section V is unavoidably formed at the ride-over region X2 at an upstream side of the turning point TC2 between the riding and obliquely crossing winding part RM (L (2; 1, 2; 1, 5)) and the transverse winding part Y (L (2; 2; 1, 6)) of the second row.

It should be noted that the above-mentioned protrusion H2 is specific for the wide width wire D such as the rectangular wire D having substantially constant thickness portion at the major region in the widthwise direction. More specifically, it is known that an array of protrusions called "rainbow line" is produced in a multilayer aligned-winding coil produced by winding a wire in the form of a round wire having a circular cross-section. However, the rainbow line is unavoidably formed at a part of intersection when the round wires are crossed or intersected with each other, which is essentially different from the protrusion H formed in the coil 1 in terms of the cause or reason and nature or property thereof. As described below, in the multilayer aligned-winding coil 1 by winding the wide width wire D such as the rectangular wire, it becomes possible to distribute or scatter the distortion of the configuration, due to the protrusion H, of the multilayer aligned-winding coil 1. However, the protrusion H is not distributed to a region other than the intersection in the multilayer aligned-winding coil of the round wire because the cause of the formation of the protrusion is different. The background of the reason why the difference happens is as follows; in the multilayer aligned-winding coil 1 of the wide width wire D, the winding wire parts forming an upper aligned-winding layer usually extend in a desired direction over a plane of the winding wire parts forming a lower layer, while in the multilayer aligned-winding coil of the round wire, winding wire parts forming an upper aligned-winding layer extend in parallel with winding wire parts forming a lower layer at recessed regions, each recessed region being formed a pair of adjacent winding wire parts forming the lower layer, in which a magnitude of protrusion due to the crossing or intersection of the round wires is as small as approximately $(2\text{-}3^{1/2})$ times of the radius of the round wire.

Figure 2A:
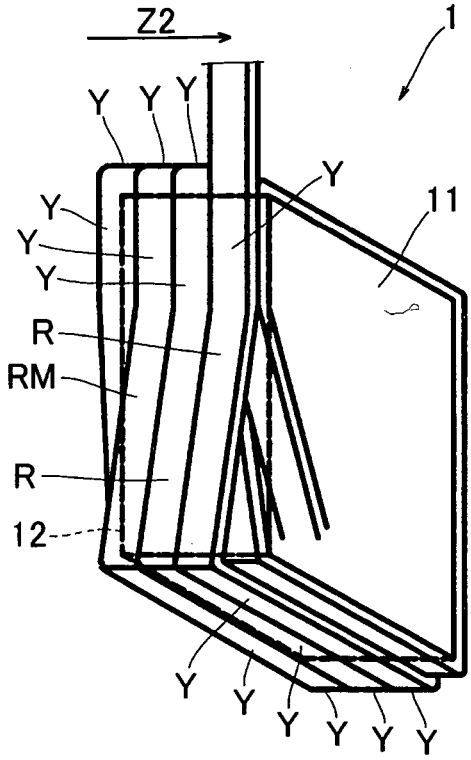

Then, as shown in FIG. 2A, sixth turn of transverse winding parts Y, Y and Y and an obliquely crossing winding part R (L (2; 2, 3; 1, 5)) and seventh turn of first transverse winding part Y (L (2; 3; 1, 6)) are formed to follow side edges of the fifth turn of transverse winding parts Y, Y and Y and the riding and obliquely crossing winding part RM (L (2; 1, 2; 1, 5)) and the sixth turn of first transverse winding part Y (L (2; 2; 1, 6)). In addition, the seventh turn of transverse winding parts Y, Y and Y and an obliquely crossing winding part R (L (2; 3, 4; 1, 5)) and eighth turn of first transverse winding part Y (L (2; 4; 1, 6)) are further formed to follow their side edges. The process of forming these winding parts Y, R by means of the winding wire D is substantially the same as the process of forming the winding parts Y, R shown in FIG. 1B except that a layer of the winding parts Y, R formed by the wire D is changed from the first layer to the second layer and that the direction of forming the winding parts Y, R by the wire D is changed from the direction Z1 (from the end face 11 to the end face 12) to the direction Z2 (from the end face 12 to the end face 11).

Figure 2B:
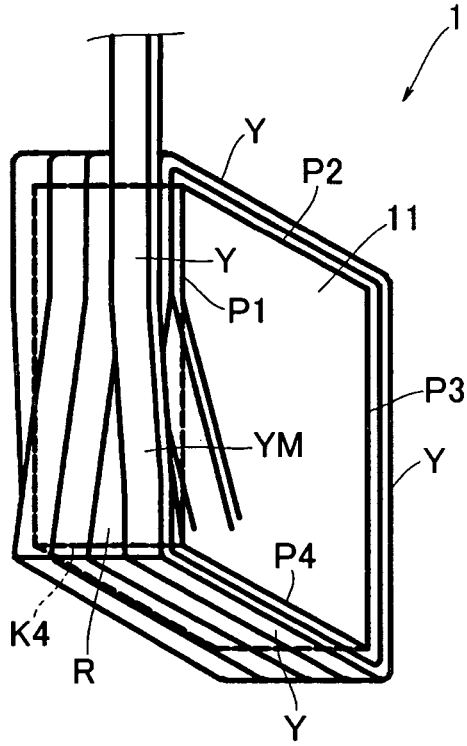

Then, as shown in FIG. 2B, after formation of the eighth turn of transverse winding part Y, Y and Y on the side faces P2, P3 and P4, a transverse winding part Y is formed all over the side face P1 from the corner K4. This transverse winding part Y is, similarly to the transverse winding part Y constituting the last part of the fourth turn and the first part of the fifth turn shown in FIG. 1C, situated at a lower layer (second layer in this case) at the region around the corner K4, and includes a progressively riding transverse winding part YM (L (2, 3; 4; 1)) riding from the second layer part progressively on the obliquely crossing winding part R (L (2; 3, 4; 1, 5)) to extend to a region on the turning point T and reaching completely an upper layer (third layer in this case) at the turning point T, and a transverse winding part Y (L (3; 1; 1, 6)) at the first row of the upper layer (third layer) extending transversely superposing on the transverse winding part Y (L (2; 4; 1, 6)) at the fourth row of the lower layer (second layer). A part of the winding wire of the third layer superposing on the fourth row (last row) of the second layer is the first row.

It is also the same as described before that the progressively riding transverse winding part YM (L (2, 3; 4; 1)) of the transverse winding part or portion Y progressively rides on the obliquely crossing winding part R (L (2; 3, 4; 1, 5)) after turning around the rounded corner K4.

Figure 2C:
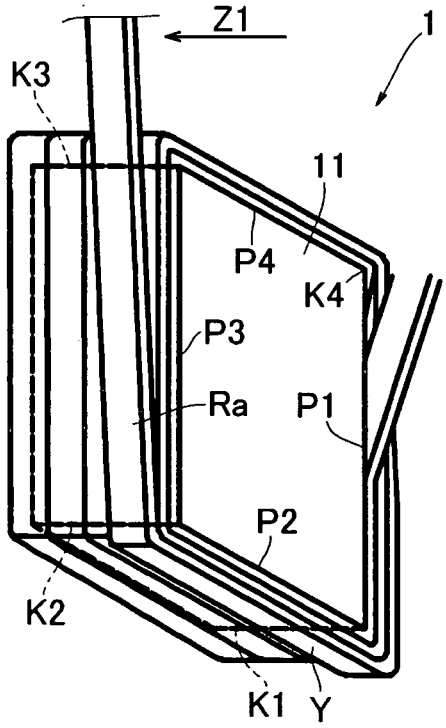

Then, as shown in FIG. 2C, the transverse winding part Y at the first row of the third layer is formed on the side face P2 in the same manner as described above and reaches the corner K2. FIG. 2C is different from FIG. 2B etc because it is an oblique explanatory view in which the side face P3 is viewed obliquely from a lower position instead of the side face P1 being viewed obliquely from the lower position.

In the multilayer aligned-winding coil 1, the winding of the wire D at the 8.5th turn (or 8.375th turn if the initial position of the winding is assumed to be the center in the transverse direction on the side face P1) and thereafter is made in a manner essentially different from that for the conventional coil shown in FIGS. 19A to 23B. The winding, of the wire D, described hereinbefore with reference to FIGS. 1A to 1D and 2A to 2B includes various details different from that for the conventional coil 301 although it is roughly similar to the that for the conventional coil 301.

The rectangular winding wire portion D having reached the corner K2 In the third layer, as shown in FIG. 2C, takes a form of quasi-obliquely crossing winding part Ra extending obliquely on the side face P3. The quasi-obliquely crossing winding part Ra is in a state to be represented as L (3; 1, 1+$\alpha$; 3, 5), where $0<<\alpha<0.5$, in the expression mentioned above. More specifically, the quasi-obliquely crossing winding part Ra has a smaller degree of oblique inclination or magnitude of shift (magnitude of deviation in the extending direction of the axis C in case of extending from a starting corner of a side face to an end corner of the side face) than the obliquely crossing winding part R described above, and is deviated or shifted by a length, in the extending direction Z1 of the axis C, less than Db/2 (a half of the width Db of the rectangular wire D) during extending to be wound from the corner K2 as the starting point of the side face P3 to the corner K3 as the ending point thereof.

Figure 5B:
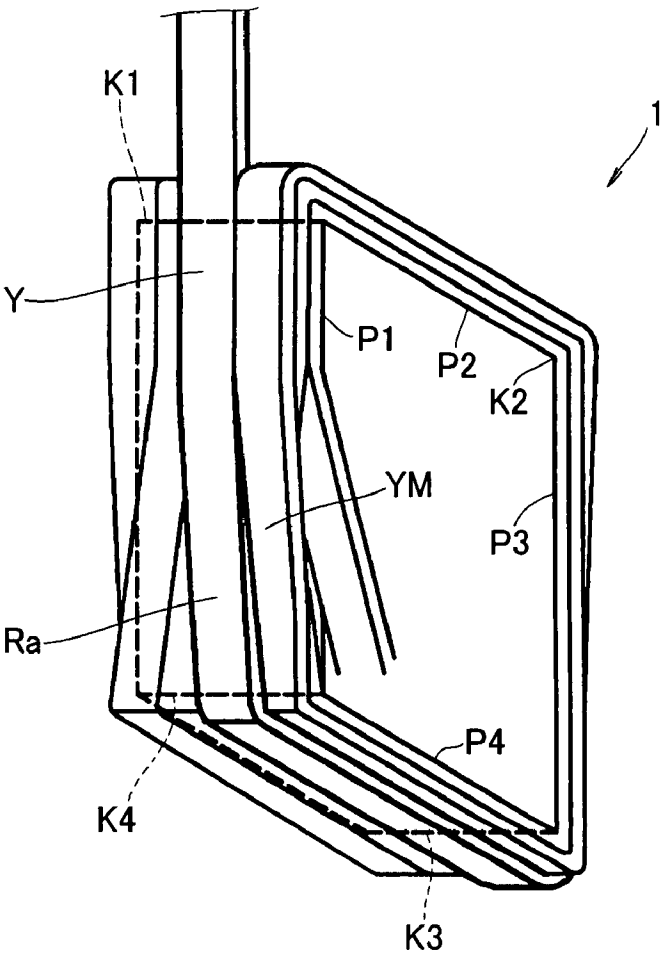
Figure 5A:
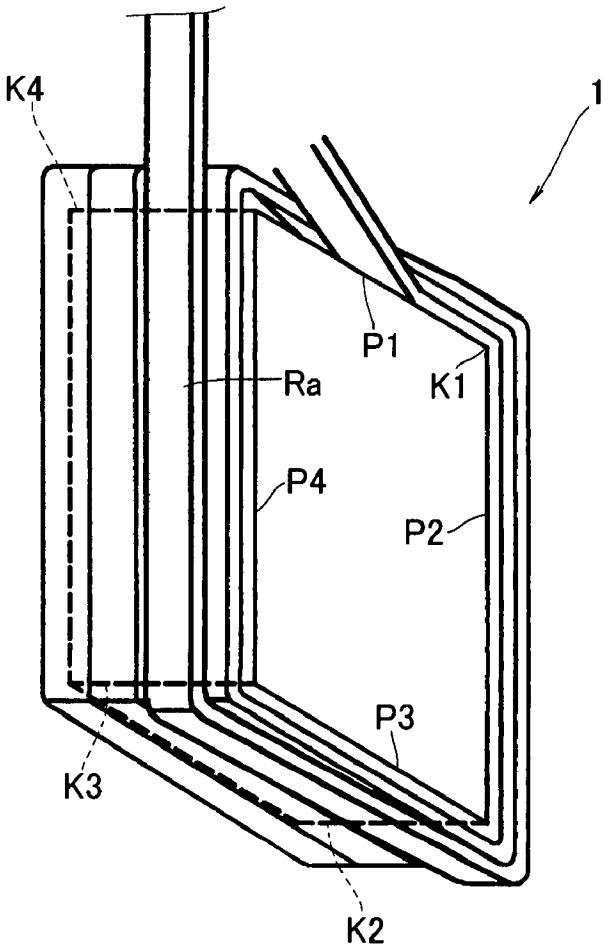

The rectangular wire D having reached the corner K3, as shown in FIG. 5A, forms a similar quasi-obliquely crossing winding part Ra (L (3; 1+$\alpha$; 1+2$\alpha$; 4, 5)) and then reaches the corner K4 at a position slightly before the second row. Then, the rectangular wire D, as shown in FIG. 5B, having formed a quasi-obliquely crossing winding part Ra (L (3; 1+2$\alpha$, 2; 4, 5)) at the ninth turn, takes a form of transverse winding part Y (L (3; 2; 1, 6)). The quasi-obliquely crossing winding part Ra completes the oblique extension (oblique crossing) on the progressively riding transverse winding part YM (L (2, 3; 4; 1)) within a range where the progressively riding transverse winding part YM (L (2, 3; 4; 1)) substantially remains at the second layer, and the direction thereof is changed or turned slightly to be extend to the transverse winding part Y (L (3; 2; 1, 6)). The transverse winding part tY (L (3; 2; 1, 6)) extends in the transverse direction F along the side edges of the progressively riding transverse winding part YM (K (2, 3; 4; 1)) and transverse winding part Y (L (3; 1; 1, 6)) at the first row. The rectangular wire D having reached the corner K1, as seen from FIG. 2D, also takes a form of Y (L (3; 2; 2, 6)) on the side face P2 of the 9.25th turn. The turning point T3 produced extends in a plane parallel with the side face P1 in the similar manner as the turning point T1.

Figure 2D:
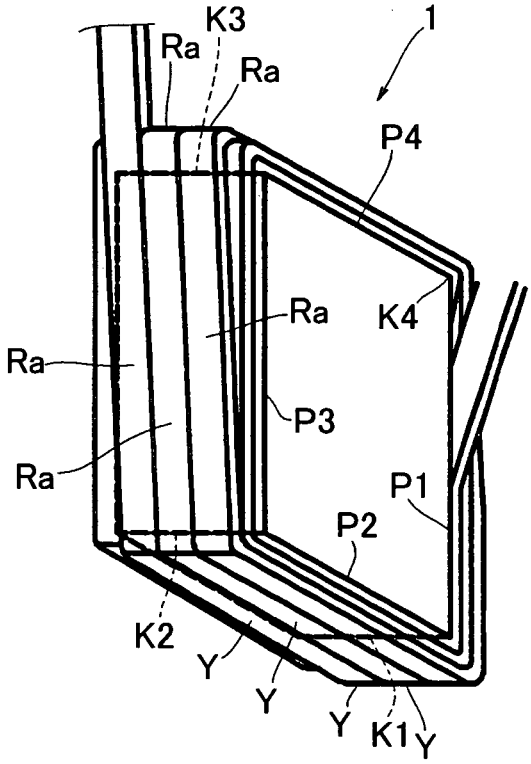

Further, as seen from FIG. 2D, 9.5th to 10.25th turn of winding parts Ra; Ra; Ra, Y; Y are formed on the side faces P3; P4; P1; P2 along the 8.5th to 9.25th turn of winding parts on the side faces P3; P4; P1; P2. Moreover, as seen from FIG. 3A, 10.5th to 11.25th turn of winding parts Ra; Ra; Ra, Y; Y are formed in the same manner on the side faces P3; P4; P1; P2.

In the above-mentioned winding, $\alpha<0.5$ is selected, so that the winding parts D taking the form of quasi-obliquely crossing winding parts Ra, Ra, Ra on the side faces P3, P4 and a starting region of the side face P1 remain partially on the first row of the third layer at the corner K4 which is a position slightly before entering the ninth turn. Thereby, it is ensured that the winding wire D should partially remain at the first row of the third layer. In addition, the magnitude of the shift $\alpha\sim0.5$ (typically $0.4\leqq\alpha<0.5$) is selected so as to avoid substantially that the winding wire D having taken the form of quasi-obliquely crossing winding parts Ra, Ra, Ra on the side faces P3, P4 and a starting region of the side face P1 is superposed on a part (part having approached the third layer), of the progressively riding transverse winding part YM (L (2, 3; 4; 1)), having substantially started its progressive riding and having been wound at a position higher than the second layer.

The value of α is selected to change or transfer the region where the protrusion H is formed from the side face P1 to the opposite side face P3 in case of the square cross-section S. Therefore, in a case where the relative position of the side face where the protrusion is to be moved or transferred is different although the cross-section is square, the value of α is different. Similarly, in a case where the cross-section is different from the square S and in a case where the value of α can be defined, the value to be taken for α is different.

In the description above, it is assumed that the quasi-obliquely crossing winding parts Ra are inclined in the same manner, on the side faces P3, P4 and P1. However, the inclinations at the side faces P3, P4 and P1 may be different from each other. Such being the case, when the magnitude of the shift or deviation α at the side faces P3, P4 and P1 are assume to be α3, α4 and α1, it is required that the sum thereof, i.e. (α3+α4+β*α1) should be equal to "1", where β=½, for example, assuming that the progressive riding is allowed over half of the side face P1, while the other condition such as β<½ may be taken, if desired.

It is noted the protrusion is not substantially produced when the above-mentioned quasi-obliquely crossing winding part Ra is formed on winding wire part of the second layer. In the multilayer aligned-winding coil 1, it has become possible to change or transfer the side face or region where the protrusion H is formed because the winding wire is made of the wire D of wide width such as the rectangular wire. In contrast, if it is assumed that the winding wire is in the form of the round wire, when the quasi-obliquely crossing winding part is formed by the round wire, such quasi-obliquely crossing winding part unavoidably crosses the winding wire parts therebelow forming the second layer and unavoidably produces the protrusions at portions of intersection or crossing, i.e. at portions where the maximum diameter parts crosses each other. In other words, if the quasi-obliquely crossing winding part is intentionally formed in the multilayer aligned-winding coil produced by winding the round wire, the positions of the protrusions are changed and the excess protrusions are produced.

Figure 3A:
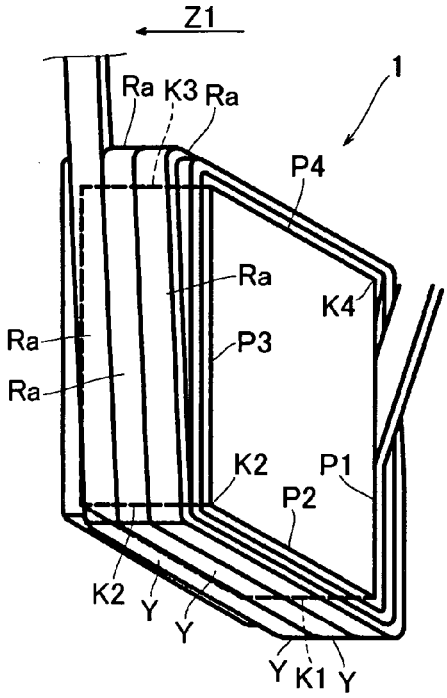
Figure 3B:
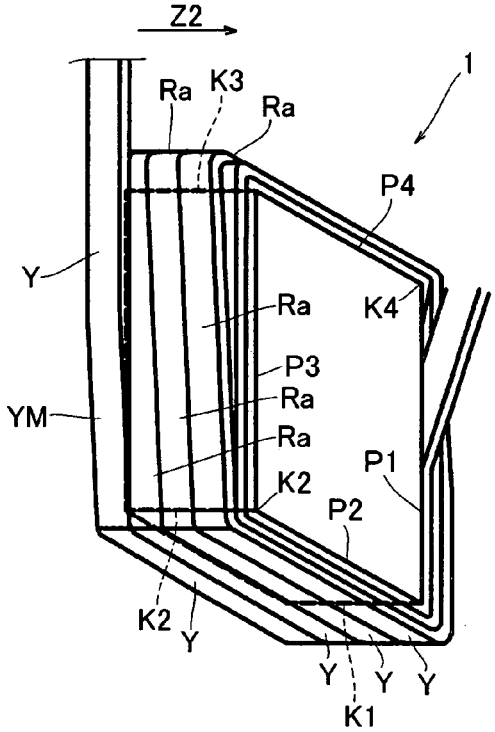

When 11.25th turn of the winding wire part Y reaches the corner K2, as seen from FIG. 3B, 11.5th turn of the transverse winding part Y is formed on the side face P3. This 11.5th turn of transverse winding part Y comprises a progressively riding transverse winding part YM (L (3, 4; 4; 3, 6)) riding progressively on the former half part of the quasi-obliquely crossing winding part Ra (L (3; 3, 3+α; 3, 5)) shown in FIG. 3A similar to FIG. 2D, and a transverse winding part Y (L (4; 1; 3)) at the first row of the fourth layer extending in the transverse direction on the latter half of quasi-obliquely crossing winding part Ra (L (3; 3, 3+α; 3, 5)). The transverse winding part Y is, however, situated at a position of the corner K3 deviated in the direction Z1 by (1−α) in a unit of row with respect to the quasi-obliquely crossing winding part Ra (L (3; 3, 3+α; 3, 5). The progressively riding transverse winding part YM (L (3, 4; 4; 3, 6)) substantially forms a winding wire part of the third layer closely contacted with the winding wire part of the second layer without superposing on the quasi-obliquely crossing winding part Ra (L (3; 3, 3+α; 3, 5)) in the vicinity of the corner K3 after having turned around the actually rounded corner K3, and begins to ride on the quasi-obliquely crossing winding part Ra (L (3; 3, 3+α; 3, 5)) after having departed from the corner K3 to some extent.

As seen from the description above, in the multilayer aligned-winding coil 1, each of the first and second layers has for rows of winding wire parts (four turns of winding wire parts) on all side faces, while the third layer has four rows of winding wire parts on two side faces (a half of the side face P1, the side face P2, and a half of the side face P3) and three rows of winding wire parts on the remaining side face parts, which corresponds to the 3.5 turn of winding wire parts. Thus, number of turns at the third layer is smaller than that of each of the first and second layers by 0.5 turns. In the multilayer aligned-winding coil 1, it has been made possible to suppress the distortion of the shape of the profile of the winding wire, e.g. to suppress the excessive protrusion of only one part, and to maximize the number of turns of the multilayer aligned-winding coil 1 disposed in a space of a predetermined cross-section such as rectangle, thereby enhancing the space factor as a whole. Furthermore, it is made possible to avoid that the aligned-winding is prevented by the excessively enlarged protrusion.

Figure 3C:
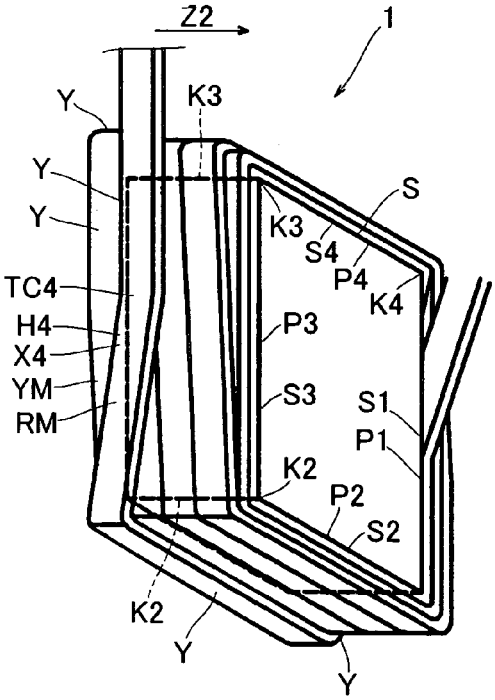

Then, as seen form FIG. 3C, transverse winding parts Y (L (4; 1; 4)), Y (L (4; 1; 1)) and Y (L (4; 1; 2)) at the first row of the fourth layer are formed on the side faces P4, P1 and P2.

This 11.5th to 12.25th turn of winding wire parts take substantially the same form as 4th to 4.75th turn of winding wire parts (formed at the first row of the second layer after having transferred from the first layer to the second layer) shown in FIG. 1D, except that the parts are formed at the first row of the fourth layer after having transferred from the third layer to the fourth layer.

Figure 3D:
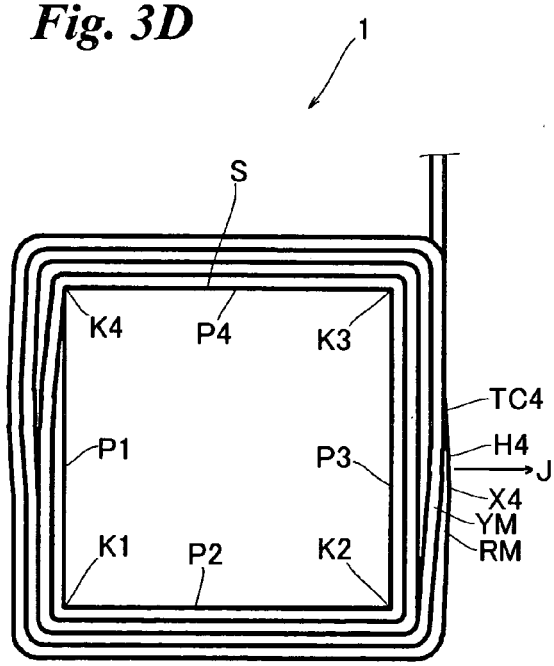
Figure 4A:
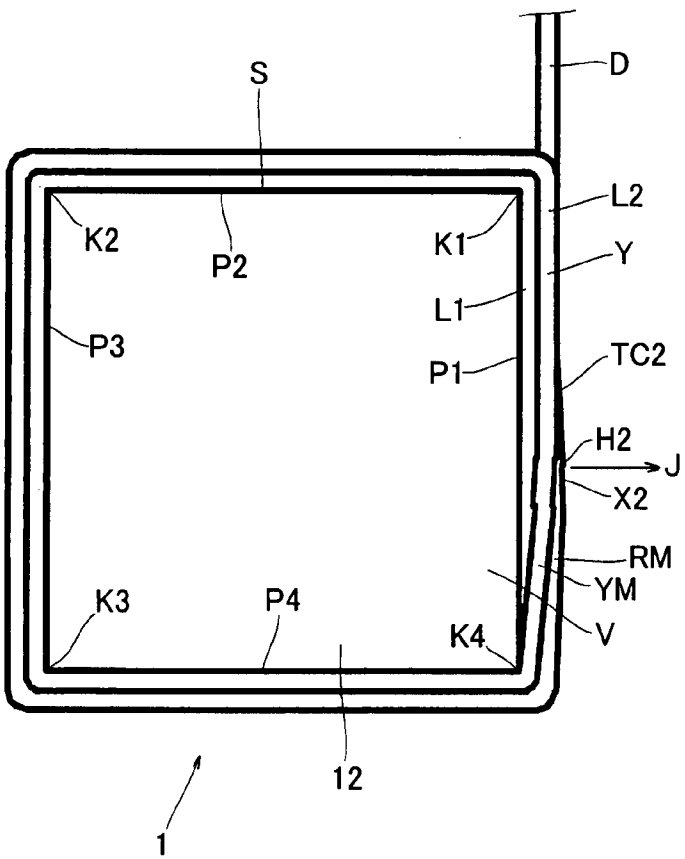

Therefore, the next winding wire parts shown in FIGS. 3C and 3D, i.e. 12.5th turn of winding wire part takes substantially the same form as the fifth turn of winding wire part shown in FIG. 1D and FIGS. 4A and 4B.

Figure 6B:
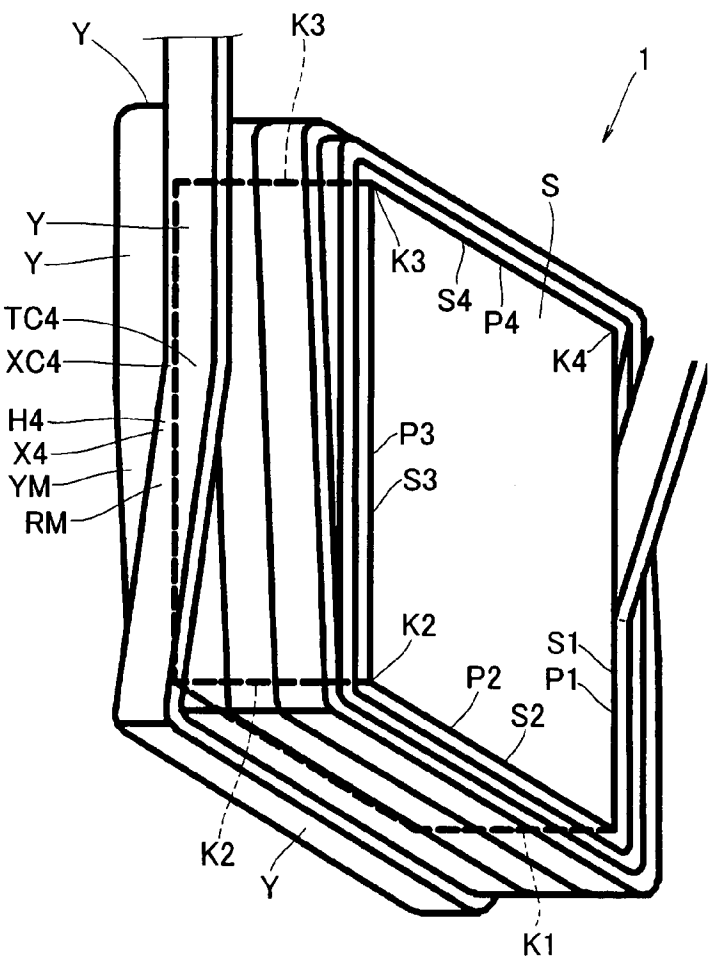
Figure 6A:
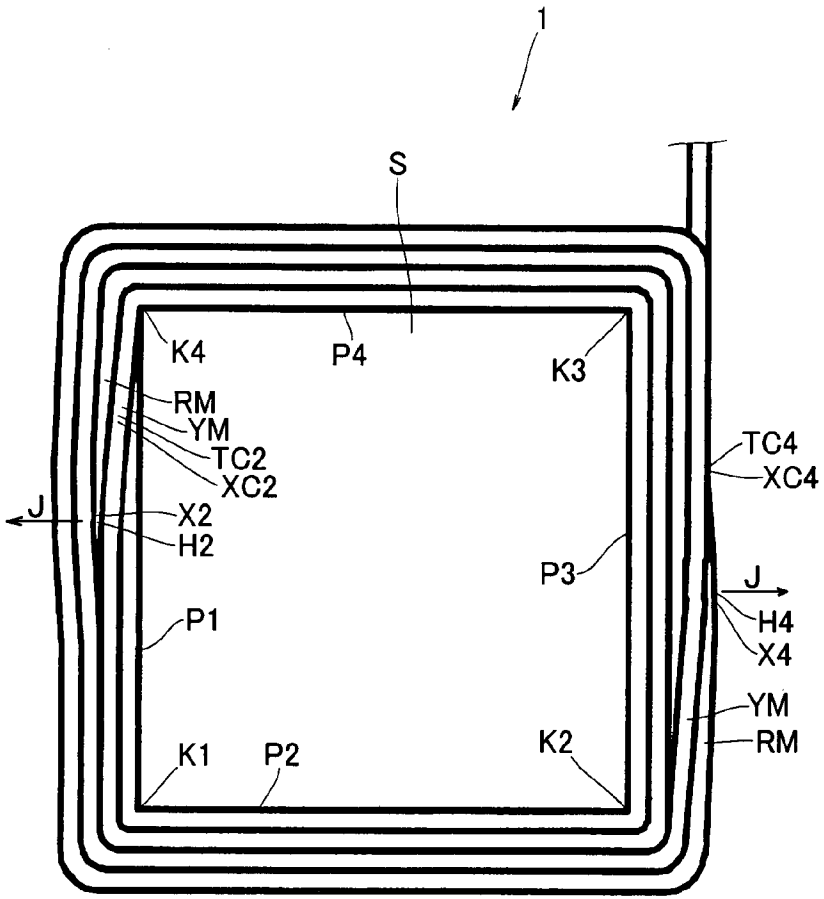

As shown in FIGS. 3C and 3D as well as FIGS. 6B and 6A corresponding to their enlarged views, a riding and obliquely crossing winding part RM (L (4; 1, 2; 3, 5)) extending to obliquely cross on the outer surface of the progressively riding transverse winding part YM (L (3, 4; 4; 3, 6)) after having turned around the corner K2 of the first row and having returned the side S3 or side face P3, and a transverse winding part Y (L (4; 2; 3, 6)) at the second row of the fourth layer extending in the transverse direction F along the side edge of the transverse winding part Y (L (4; 1; 3, 6)) of the first row of the fourth layer after having been turned at an extended end of the riding and obliquely crossing winding part RM (L (4; 1, 2; 3, 5)) are formed.

A turning point TC formed at a boundary between the riding and obliquely crossing winding part RM (L (4; 1, 2; 3, 5)) and the transverse winding part Y (L (4; 2; 3, 6)) is typically situated at a central part between the corners K2 and K3. However, the turning point TC4 may be situated at a position closer to the corner K2 than the corner K3 or closer to the corner K3 than the corner K2. The way of formation of the turning point TC4 is the same as that of the turning point TC2.

As illustrated in a partially enlarged plan view of FIG. 7B similarly to the situation mentioned before, in the multilayer aligned-winding coil 1 of the rectangular wire D, the riding and obliquely crossing winding part RM (L (4; 1, 2; 3, 5)) extends to cross obliquely from a riding start region YA4, of the progressively riding transverse winding part YM (L (3, 4; 4; 3, 6)), starting to ride on the quasi-obliquely crossing winding part Ra (L (3; 3, 3+α; 3, 5)) across a progressively riding region YB4, of the progressively riding transverse winding part YM (L (3, 4; 4; 3, 6)), partially superposing on the quasi-obliquely crossing winding part Ra (L (3; 3, 3+α; 3, 5)). A portion XC4, of the riding and obliquely crossing winding part RM (L (4; 1, 2; 3, 5)), where the part RM (L (4; 1, 2; 3, 5)) completes the oblique crossing of the progressively riding transverse winding part YM (L (3, 4; 4; 3, 6)) is situated substantially at the fifth layer L5. A region X4 (filled with black or solid circles "●" in FIG. 7B), of the riding and obliquely crossing winding part RM (L (4; 1, 2; 3, 5)), superposing on the progressively riding transverse winding part YM (L (3, 4; 4; 3, 6)) situated on the quasi-obliquely crossing winding part Ra (L (3; 3, 3+α; 3, 5)) reaches a position significantly higher than the fourth layer L4. On the other hand, a portion, of the riding and obliquely crossing winding part RM (L (4; 1, 2; 3, 5), having descended onto the third layer (lower layer) L3 is situated just at the fourth layer (upper layer) L4. Therefore, as shown in FIGS. 6A and 6B, it is also the same as the protrusion H2 that the protrusion H4 is unavoidably formed to protrude in the outward direction J of the square S viewed in a plane parallel with the cross-section V at a ride-over region X4 before the turning point TC4 between the riding and obliquely crossing winding part RM (L (4; 1, 2; 3, 5)) and a transverse winding part Y (L (4; 2; 1, 6)) at the second row.

As seen from FIG. 3D and FIG. 6A illustrating an enlarged view thereof, the protrusion H4 produced at the region X4 before TC4 is situated at the side face P3, which is different from the side face P1 where the protrusion H2 is produced at the ride-over region X2 before the turning point TC2. In other words, the protrusion H4 is produced at a region (site) completely different from the protrusion H2 and therefore every region of an outer surface of the multilayer aligned-winding coil 1 remains to have, at most, a protrusion corresponding to one protrusion H in a state of the coil having up to four layers. In addition, as seen from FIGS. 3D and 6A, the winding wire portions of the third and fourth layers are formed on the protrusion H2 produced at the second layer, thereby smoothing the region around the protrusion H2 to be flattened as a whole. More specifically, because there is a local projection or protrusion at a region of the protrusion H2 on the outer surface of the second layer, the winding wire portion wound thereon is likely to be distorted or disordered. However, the projection or protrusion around the region of the protrusion H2 is more evenly flattened on the outer surface of the fourth layer in the multilayer aligned-winding coil 1, and it is ensured that the possibility of the disorder or distortion of the winding wire to be wound thereover is decreased.

Thus, in the multilayer aligned-winding coil 1 with the regions of the protrusions H distributed or scattered, it is possible to avoid that only one portion or limited portions of the coil 1 is protruded outwards. Therefore, it is ensured that the multilayer aligned-winding coil 1 can be received in a limited dimension (width, thickness or length) of gap, thereby enabling to maximize number of turns of the multilayer aligned-winding coil 1 capable of being received in the limited dimensions of gap. In other words, it becomes possible to maximize the number of turns or space factor of the multilayer aligned-winding coil 1 received in the limited dimension of gap.

Because it is possible to avoid only one or limited portions of the coil 1 to be protruded outwards in the multilayer aligned-winding coil 1 with thus distributed regions of the protrusions H, number of superposed layers of the winding wire can be maximized while minimizing the possibility that the wound wire D may break down or collapse. Therefore, it becomes possible to produce multilayer coil while minimizing the possibility of collapsing or breaking-down of the wound wire D.

After the transverse winding part Y (L (4; 2; 3, 6)) at the second row of the fourth layer reaches the corner K3, 12.75th to 13.5th turn and 13.75th to 14.5th turn of transverse winding parts Y; Y; Y; R, Y are formed on the side faces P4; P1; P2; P3 along the adjacent row of the winding wire parts. Then, 14.75th to 15.25th turn of winding wire parts Y, Y and Y are formed on the side faces P4, P1 and P2, where 14.75th turn and 15th turn of transverse winding parts Y ride partially on the quasi-obliquely crossing winding parts at the first row of the third layer at the corners K3 and K4. This is made possible by the condition $\alpha<0.5$ as mentioned before.

Figure 8B:
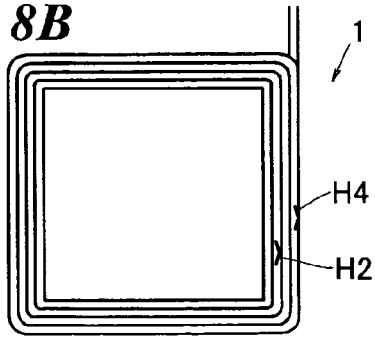

Now, before describing the superposition of fifth and further layers, simplified way of expression is briefly explained referring to FIGS. 8A and 8B. In FIG. 8A, upon superposition of fourth layer, the fourth layer of protrusion H4 is formed at a position slightly deviated, with respect to the direction of superposition, from that of the second layer of protrusion H2 associated with the ride-over region X corresponding to the highest ride-on portion. These protrusions H2, H4 produced at the ride-over regions X corresponding to the highest ride-on regions are shown in FIG. 8B by "V"-shaped marks (a pair of legs forming the shape "V" are arranged at obtuse angles) at positions, of second and fourth layers, slightly deviated with each other relative to the direction of superposition of layers. Although the actual winding wire D is a continuous line, layers are illustrated in the simplified drawings as if they are simply superposed layers.

Figure 8C:
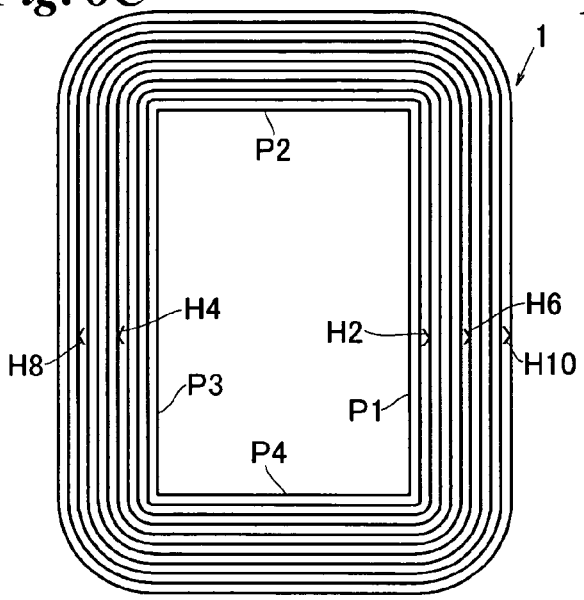

Now, coils having more than five layers will be described with reference to FIG. 8C showing the state of superposition of winding wires in a simplified form. In the multilayer aligned-winding coil 1 of FIG. 8C, the first and second layers are formed so that the second layer has, on the side face P1, the ride-over region or the highest ride-on region X2 including the protrusion H2 near the turning point TC2, while the third and fourth layers are formed so that the fourth layer has, on the side face P3 opposite to the side face P1, the ride-over region or the highest ride-on region X4 including the protrusion H4 near the turning point TC4. Therefore, when fifth or further layer is formed in the same manner in the multilayer aligned winding coil 1, the fifth and sixth layers are formed so that the sixth layer has, on the side face P1 opposite to the side face P3, the ride-over region including the protrusion H6. Similarly, formation of two layers of seventh and eighth layers and two layers of ninth and tenth layers are repeated as desired. The positional relationship of the third and fourth layers relative to the second layer is the same as the positional relationship of the fifth and sixth layer relative to the fourth layer. Similar relationship is taken for further layers.

when the cross-sectional shape of the multilayer aligned-winding coil 1 is not square but rectangular or oval, side faces corresponding long sides or major sides of the rectangle or oval are typically selected as the side faces P1, P3 of FIG. 8C.

Figure 8D:
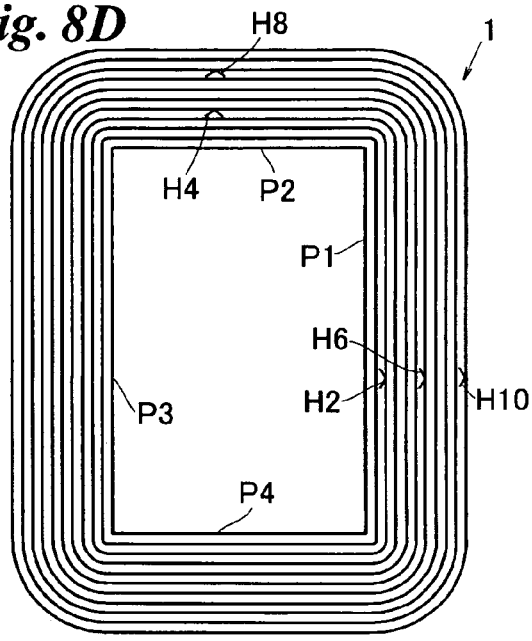

The side face for distributing or spreading the protrusion H at every two layers may be, instead of the side face P3 opposite to the first side face P1, the side face P2 as shown for example in FIG. 8D or its substantially equivalent side face P4. When the cross-sectional shape of the multilayer aligned-winding coil 1 is rectangular or oval, the side faces P2, P4 correspond to a short side or an arcuate side, if the side faces P1, P3 correspond to the long side.

Figure 8E:
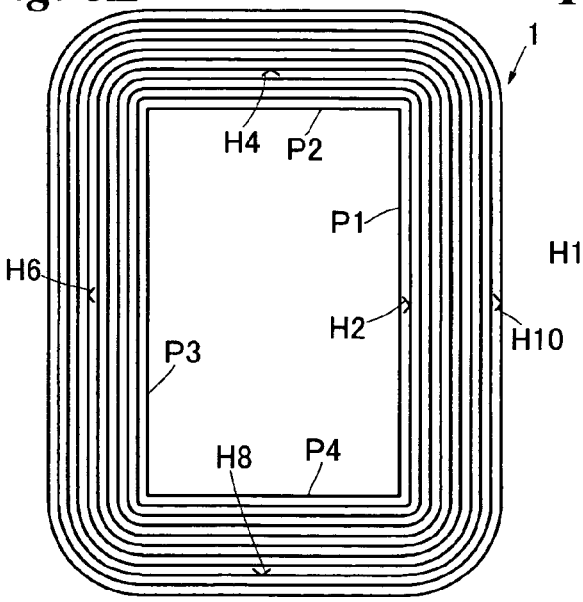
Figure 8F:
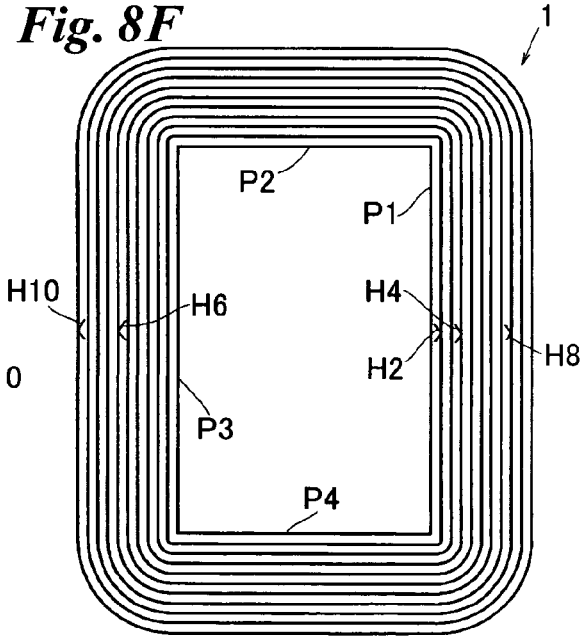

Instead of taking two side faces in turn as the side faces for positioning the protrusions H, progressively varied side faces such as P1→P2→P3→P4→P1→(repeated) may be selected as shown in FIG. 8E or side faces may be selected substantially in random order.

Although it should be precluded that multiple layers are superposed in such a manner that the protrusions H are formed at the same region of the same side face, it is not absolutely precluded that protrusions H are formed a few times successively (for example, second layer, fourth layer and sixth layer) at the same region of the same side face (e.g. side face P1). As described before, it is preferred to be wound in such a manner that the protrusions H are superposed at the same side face(s) in view of the space factor. Therefore, in a case where it is allowable or tolerable that a relatively large protrusion is formed on the outer surface of the multilayer aligned-winding coil 1, it may be repeated to form the protrusion H at the same side face so long as accumulation of the protrusions does not produce an excessively large protrusion which makes it difficult to perform the aligned-winding, while changing the side face for forming the protrusion H to an other side face to distribute the region of forming the protrusion H when it comes to difficult to perform the aligned-winding. Even though the protrusions H are superposed, it is general that a peak of the protrusion H of a layer is more or less deviated from a peak of the protrusion H of the lower layer thereunder, and therefore it is a possible choice to repeat to superpose the protrusions a few times in order to maximize the number of turns.

It is possible to shift the region of forming the protrusion H to some extent, even though the protrusions H are successively formed on the same side face. Typically, when the tension of the winding wire D is made somewhat higher, the turning point T is displaced to same extent in a forward winding direction (in a direction to which the winding wire advances) of the multilayer aligned-winding coil, while the turning point T is displaced in the backward winding direction, when the tension of the winding wire D is made lower. In a case where the side face the protrusion is formed is the long side of the rectangle in view of the cross-section and where the long side is relatively long, the long side may be regarded as being constituted by plural angular regions (equivalent to angular regions $\phi$1, $\phi$2, to be described later with reference to FIGS. 11A to 11C) to distribute the protrusions at the plural different regions.

Upon forming the multilayer aligned-winding coil made of layers fairly greater than ten layers, same type of two layers may be repeatedly formed a few times (e.g. about 2 to 3 times) in such a manner that the protrusions H are formed on the similar regions of the same side face. For example, in the multilayer aligned-winding coil 1 shown in FIG. 8F, although the protrusions H2, H4 are successively formed on the side face P1, the protrusion H6 is changed to the side P3 relative to the side face P1 where the protrusion H4 is formed, thereby averaging the enlarged protrusion due to the accumulation of the successive protrusion H2, H4. Protrusions H4, H6, H8 and H10 are formed on the varied side faces P1, P3, P1 and P3 to suppress the accumulation of the protrusion H.

Figure 9A:
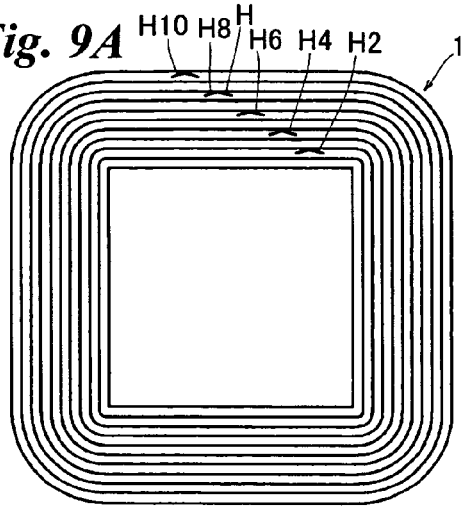
Figure 9B:
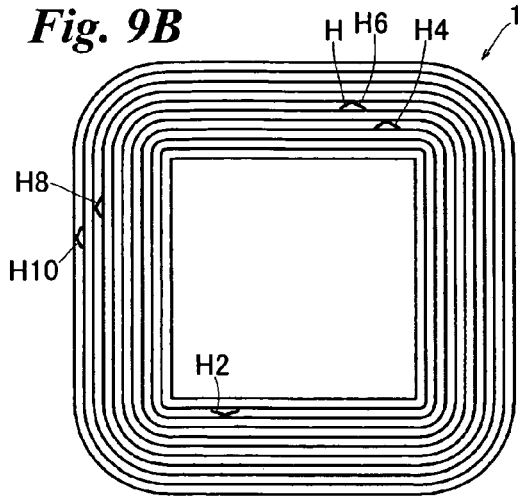
Figure 9C:
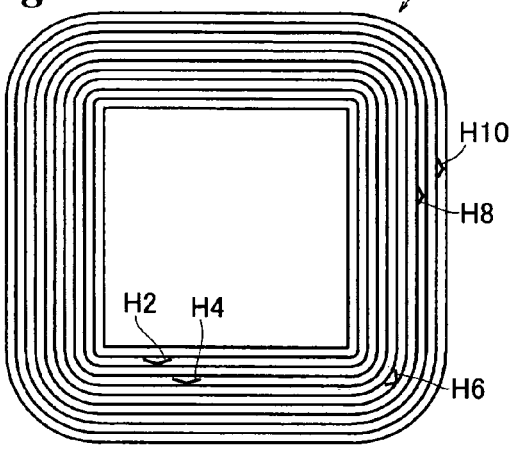
Figure 9D:
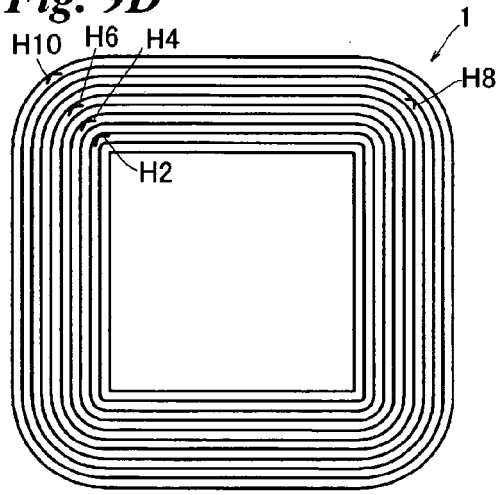
Figure 9E:
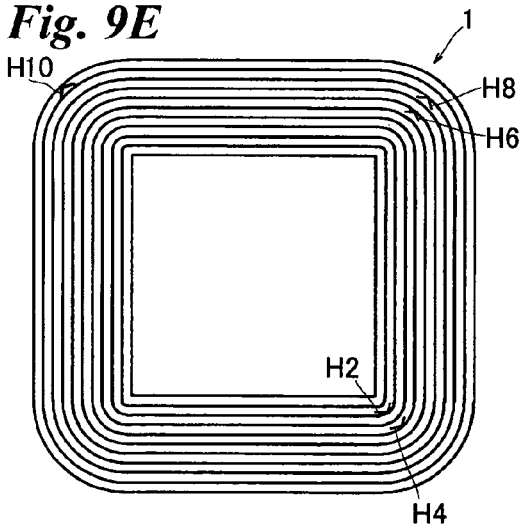
Figure 9F:
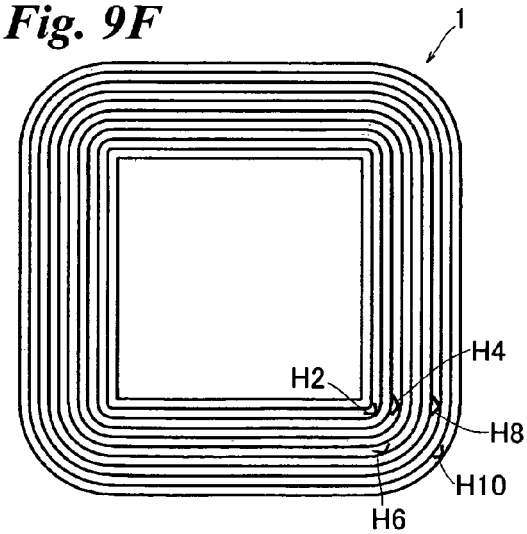

The regions having the protrusions H may be changed or distributed for example as shown in FIGS. 9A, 9B, 9C, 9D, 9E and 9F. In each of FIGS. 9A to 9F, the coil is illustrated as having a square cross-section. In the example of FIG. 9A, the coil has protrusions H, i.e. H2, H4, H6, H8 and H10 at relatively slightly shifted positions on the same side face (P2 in this case). In the coil of FIG. 9B, positional deviation of the protrusions H on the same side face and change of the side faces are combined. In the coil of FIG. 9C, utilization of the corner (which should be more or less rounded, and the radius of curvature increases as the layer becomes outer one) in addition to the positional deviation of the protrusions H on the same side face and change of the side faces are combined. In the coil of FIG. 9D, the same corner is used plural times for the protrusions H, while some protrusion(s) (H8 in this case) is(are) formed at a different corner to avoid excessive superposition of the protrusions at the same corner. FIGS. 9D to 9F shows examples in which the protrusions H are all formed at the corners. In the coil of FIG. 9E, the protrusions H are distributed to avoid excessively successive superposition of the protrusions H, which is an example where the successive superposition is not greater than twice. In the coil of FIG. 9F, the protrusions are formed roughly at the same corner but are distributed over the arcuate region.

As described above, the coil having, in distributed manner, the protrusions H at the side face(s) and corner(s), outer layer of which can be treated as the spatially spread region, can be produced in the form of aligned-winding coil without possibilities of collapsing.

The distribution or spreading of the protrusions H is also useful in the multilayer aligned-winding coil 1 having relatively small number of layers. More specifically, in a case where it is necessary to avoid the protrusion of the outer surface of the multilayer aligned-winding coil 1 as little as possible, the portion of the protrusion H is distributed at least once (one layer) to suppress the variation in the thickness of the multilayer aligned-winding coil 1 and to minimize the disorder thereof, even though the number of layers are relatively small.

Moreover, as shown in FIG. 11A for example, in the multilayer aligned-winding coil 1 having a cross-section in the form of a curved outline or contour such as a circle, the regions of the protrusions H2, H4 and H6 etc are distributed to different central angle regions or angular regions $\phi$1, $\phi$2 and $\phi$3 etc (expressed by $\phi$ when they are not discriminated or treated collectively). The central angle region $\phi$ is taken to be a region substantially greater than the width of the protrusion H in the form of mountain and has a boundary at or outside of the tale of the mountain-like protrusion H. Although the winding wire layers are not shown concretely in FIG. 11A, the protrusions H2, H4 and H6 are assumed to be attributed to the ride-over regions X2, X4 and X6 situated before the turning points TC2, TC4 and TC6 of the second, fourth and sixth layers.

The concept of the central angle region or angular region $\phi$ mentioned above is, as shown in FIG. 11C, applicable to the multilayer aligned-winding coil of oval cross-section having linear parts and curved parts. When the linear part is long enough, the parts may be regarded as being constituted by plural central angle regions or angular regions $\phi$1, $\phi$2 etc where the protrusions H2, H4 etc are formed. Such provision can be similarly applied to the long side of the multilayer aligned-winding coil having the rectangular cross-section as shown in FIGS. 8A to 8D. More specifically, the protrusions H of different layers may be formed at different central angle regions or angular regions $\phi$ on the same side face in a distributed manner instead of being formed on the different side faces.

Although two layers are described to constitute a set for forming the protrusions H on the same side face (at the same central angular region), the set may not be constituted by every two layers in the multilayer aligned winding coil 1. Although the protrusion H2 of the second layer and the protrusion H3 of the third layer are situated on the same side face P1, the protrusion H3 of the third layer may be situated at the side face P2, P3 or P4 different from that of the protrusion of the second layer, which can be similarly to other layers such as the fourth layer and the fifth layer. More specifically, for example, the protrusion H2 and the protrusion H3 being situated at different positions of the multilayer aligned winding coil 1 in the extending direction of the axis C thereof, there is little mutual influence in terms of the collective protrusion and collapse, and therefore the protrusions H2, H3 can be placed independent of each other. However, it is necessary to dare to form the above-mentioned quasi-obliquely crossing winding part YM to pace the protrusion H3 on a side face different from that for the protrusion H2, while the formation of the quasi-obliquely crossing winding part YM decreases the number of turns of the winding wire by a part or fraction of one turn. Thus, it is unavoidable that the space factor as well as the number of turn is decreased. Therefore, it is usually preferred that a set of two layers have protrusions on the same side face or central angle region rather than having the protrusion H at different the side face or central angle region in each of the layers.

The multilayer aligned-winding coil 1 thus constructed is applied for example to a position control of an article.

A position control mechanism 50 shown in FIGS. 12A and 12B, comprises the rectangular wire multilayer aligned-winding coil 1 having a rectangular cross-section and a U-shaped movable member 51. The multilayer aligned-winding coil 1 is fixed on a flat surface 55 of a coil-unit-mounting base 54 by an outer side face 53 corresponding to one long side 52 of the rectangle in the cross-section thereof. The mounting base 54 is, for example, fixed to and stationary with respect to a case (not shown) of a camera. Accuracy of orientation and degree of flatness of the surface 55 are high. The multilayer aligned-winding coil 1 is formed so that the highest ride-on portions X are distributed to distribute the protrusions H in order to minimize protrusions on the outer surfaces 53, 57 corresponding to the long sides 52, 56. Therefore, substantially all of the outer surface 53 of the multilayer aligned-winding coil 1 is fixed to the mounting base 54 in a closely contacting state with the surface 55 of the mounting base 54. In this sate, the central axis C of the multilayer aligned-winding coil 1 is parallel with the surface 55 of the mounting base 54.

The movable member 51 is, for example, fixed to a lens structure (not shown) movably supported by the case (not shown) of camera in a direction ZC relative thereto. The direction ZC is parallel with the extending direction of the central axis C of the multilayer aligned-winding coil 1. The movable member 51 comprises a U-shaped yoke plate 60 and a pair of plate-like magnets 58, 59. Each of the plate-like magnets 58, 59 is magnetized in the thickness direction. One leg portion 62 of a pair of leg portions 61, 62 constituting the yoke plate 60 is inserted through a cavity 63 in the form of rectangular column to be extended in the direction ZC.

The magnets 58, 59 applies a uniform magnetic field in a direction VM to a part, of the multilayer aligned-winding coil 1, situated between the magnets 58, 59, i.e. a winding wire part 64, at a side of the long side 56 of the rectangular cross-section of the multilayer aligned-winding coil 1. The direction VM is a direction at right angle with respect to an extending direction of the long side 56 of the rectangle of the multilayer aligned-winding coil 1, i.e. an extending direction of the winding wire D of the winding part 64, within a plane perpendicular to the central axis C of the coil 1.

When an electric current flows in directions I1, I2 through the winding wire D of the winding part 64 of the multilayer aligned-winding coil 1, the winding wire part 64 of the coil receives a force in the direction ZC2, ZC1, and the movable member 51 is moved in the direction ZC1, ZC2 respectively in response to the reaction of the force. Thus, it is possible to change the position of the lens structure (not shown) of the camera in the direction ZC by changing the direction and time of current I through the winding wire D of the multilayer aligned-winding coil 1, so as to control the focusing of the lens structure.

In the position control mechanism 50 thus constructed, when the length of the multilayer aligned-winding coil 1 is about 1 cm, magnitudes of gaps G5, G6 and G7 between the multilayer aligned-winding coil 1 and the movable member 51 are typically 0.2-0.3 mm.

In the position control mechanism 50, if there is an excessive protrusion due to accumulation of the protrusions H at the winding wire part 64 on a side of the side face 57 of the multilayer aligned-winding coil 1 of the rectangular cross-section, there is a possibility that the magnet 58 of the movable member 51 may abut against or scrape against the outer surface 57 of the winding wire part 64 of the multilayer aligned-winding coil 1, or that the magnet 59 of the movable member 51 may abut against or scrape against an inner surface 65 of the winding wire part 64 of the multilayer aligned-winding coil 1. In addition, in the position control mechanism 50, if there is an excessive protrusion due to accumulation of the protrusions H at the winding wire part 66 on a side of the side face 53 of the multilayer aligned-winding coil 1 of the rectangular cross-section, there is a possibility that the leg portion 62 of the yoke plate 60 of the movable member 51 or the magnet 59 thereof may abut against or scrape against an inner surfaces 67, 65 of the rectangular column-like cavity 63 of the multilayer aligned-winding coil 1, because of the inclination of the multilayer aligned-winding coil 1 with respect to the surface 55 of the support member 54. Moreover, such being the case, even though the above-mentioned mechanical abutment or contact does not happen, the variation in the force of the multilayer aligned-winding coil 1 applied to the movable member 51 depending on the individual products may become too large to reduce the reliability of the products.

In the multilayer aligned-winding coil 1, because the protrusion on the outer surfaces 53, 57 of the coil 1 can be minimized and the shape and dimensions of the outer surface of the multilayer aligned-winding coil 1 can be uniformized at relatively high degree of accuracy, there is little fear or possibility that the above-mentioned problems may arise. Therefore, it becomes possible to further downsize the multilayer aligned-winding coil 1. In addition, because it is possible to minimize the generation of irregular protrusion H, it becomes possible to minimize the gaps G5, G6 and G7, thereby enabling to maximize number of turns of the winding wire part 64 situated in the gap between the magnets 58 and 59. Therefore, the effective space factor of the winding wire part D situated in the gap between the magnets 58 and 59 can be maximized.

Figure 13B:
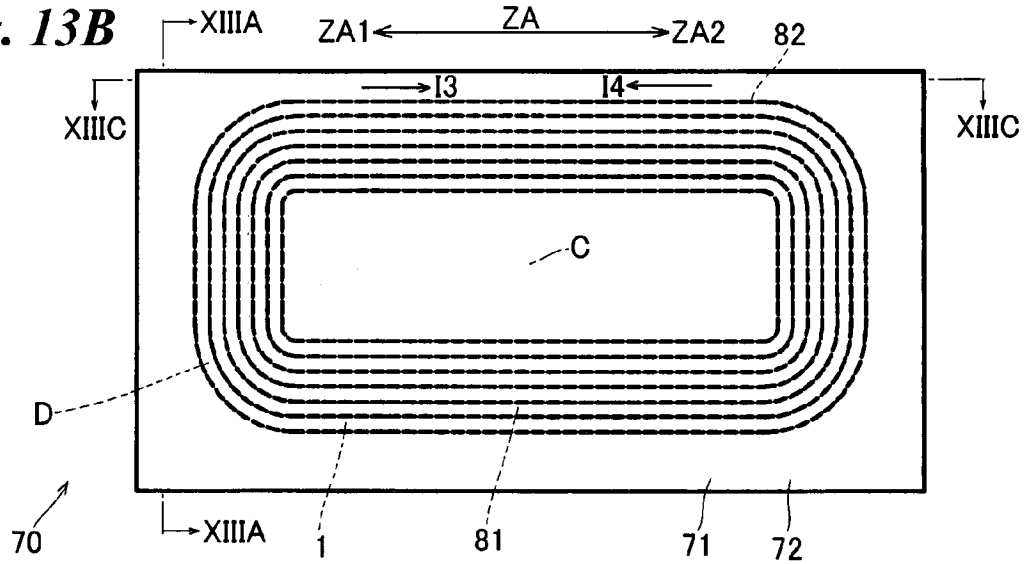
Figure 13C:
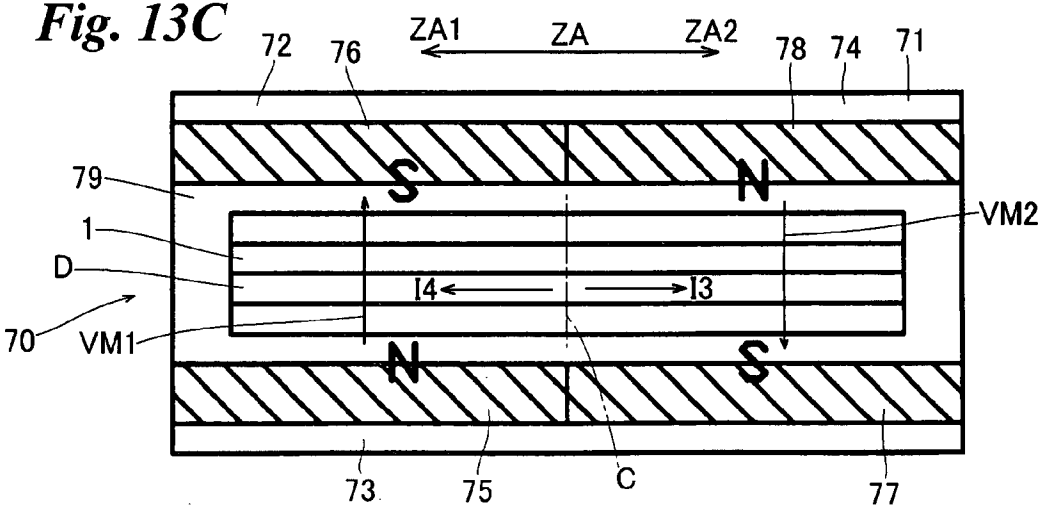
Figure 13A:
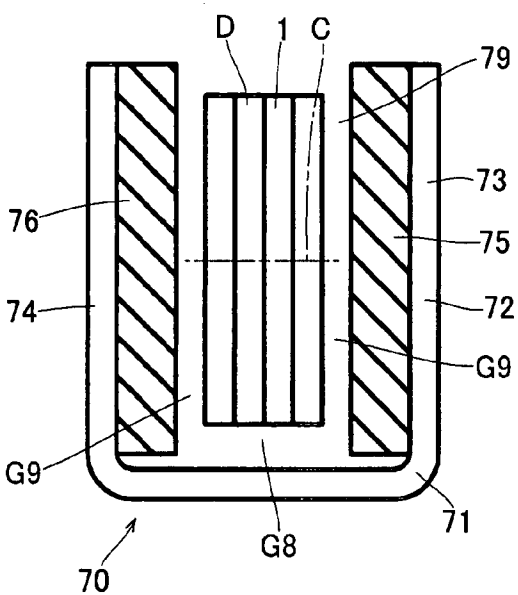

A position control mechanism 70 shown in FIGS. 13A and 13B comprises the rectangular wire multilayer aligned-winding coil 1 of rectangular cross-section, and a movable member 71 extending in the form of "U" to surround the coil 1. The position control mechanism 70 constitutes a voice coil and can be applied for example to a position control etc of an arm of a magnetic head in a magnetic disk drive.

The multilayer aligned-winding coil 1 is fixed to a support body not shown, and the movable member 71 is supported by the support body (not shown) movably in a direction ZA.

Movable member 71 comprises a yoke plate 72 having a U-shaped cross-section with respect to the direction ZA, and two pairs of plate-like magnets 75, 76 and 77, 78 fixed to a pair of leg portions 73, 74 of the yoke plate 72. Each plate-like magnet is magnetized in the thickness direction, and the magnet pair 75, 76 produce a magnetic field in a direction VM1, while the magnet pair 77, 78 produce a magnetic field in a direction VM2, i.e.—VM1.

Multilayer aligned-winding coil 1 is situated in a space 79 between the leg portions 73, 74 of the U-shaped movable member 71 and the magnets 75, 77 and 76, 78 in such a manner that the central axis C of the coil 1 extends in perpendicular to the faces of magnet pairs 75, 76 and 77, 78 and in parallel with the direction VM1, VM2 of the magnetic fields and in such a manner that the long sides 81, 82 of the rectangle in the cross-section of the coil 1 extend in parallel with the direction ZA.

When an electric current flows in one direction 13 through the winding wire D of the multilayer aligned-winding coil 1, the movable member 71 is moved in the direction ZA2 toward a position where the central axis C of the multilayer aligned-winding coil 1 faces to the center of the magnet pair 75, 76, while the movable member 71 is moved in the direction ZA1 toward a position where the central axis C of the multilayer aligned-winding coil 1 faces to the center of the magnet pair 77, 78, when the electric current flows in the other direction I4 through the winding wire D of the multilayer aligned-winding coil 1. Therefore, in the position control apparatus 70, it is possible to control the position of the movable member 71 in the direction ZA by controlling the direction and time of the current passing through the winding wire D of the coil 1.

When the length of the long side of the rectangle in the cross-section of the multilayer aligned-winding coil 1 is about 1 cm in the position control apparatus 70, gaps G8, G9 between the multilayer aligned-winding coil 1 and the movable member 71 are also, for example, about 0.2-0.3 mm.

If there is an excessive protrusion on an outer surface of the long side of the multilayer aligned-winding coil 1 in the position control apparatus 70, it is not easy to displace the multilayer aligned-winding coil 1 in the rectangular parallelepiped cavity 79. In addition, because it becomes necessary to place the multilayer aligned-winding coil 1 deep into the rectangular parallelepiped cavity 79, it becomes necessary to determine the position of the multilayer aligned-winding coil 1 considering the maximum protruding magnitude and maximum distortion of the protrusion of the multilayer aligned-winding coil 1, which results in the requirement in preparing the gap more or less G8 greater.

Now, an example of a rectangular multilayer aligned-winding coil production apparatus 20 for producing the above-mentioned multilayer aligned-winding coil 1 is described with reference to FIGS. 14, 15, and 16A to 16C.

Figure 14:
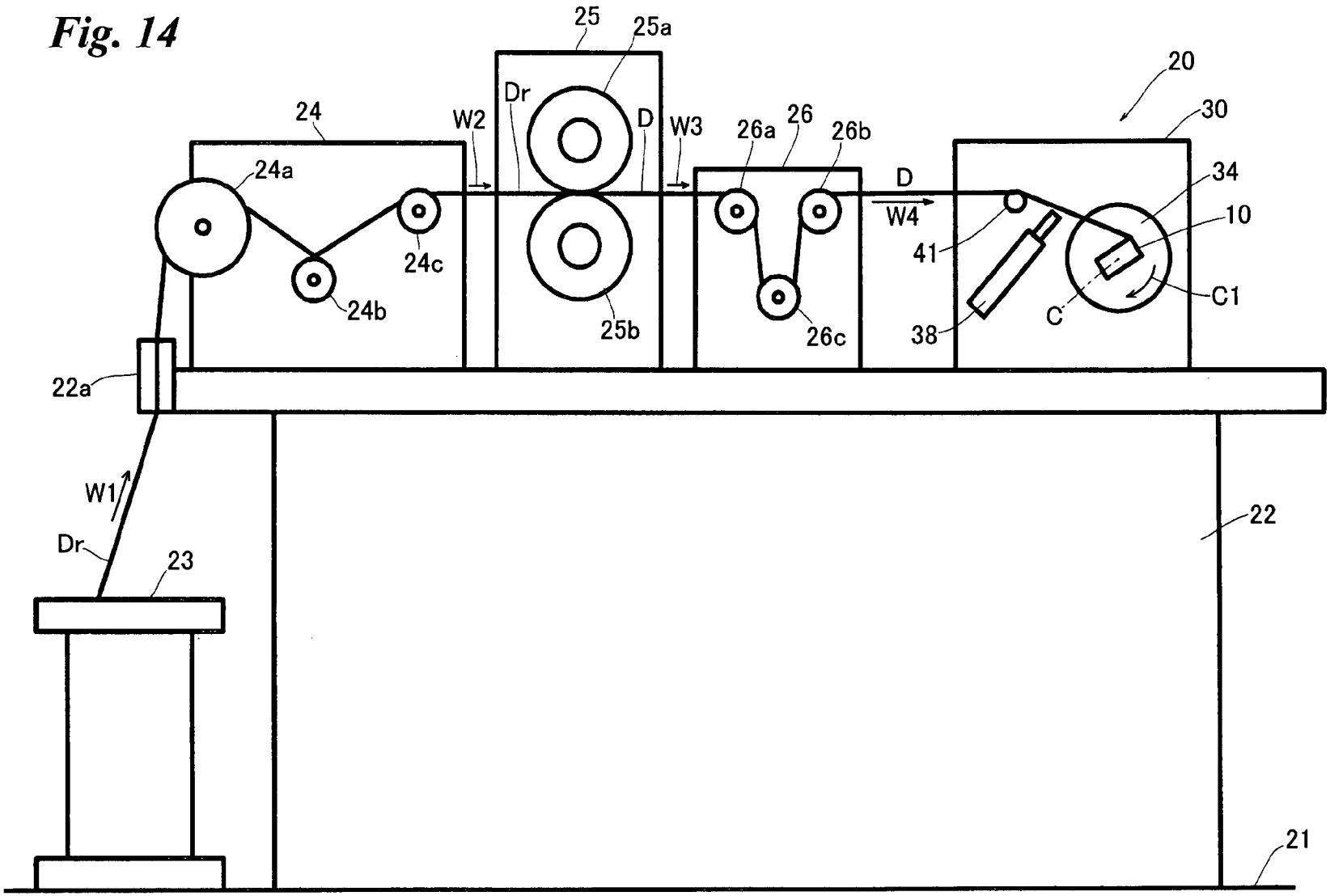
FIG. 14 is a diagrammatic front view of a multilayer aligned-winding coil production apparatus for producing a multilayer aligned-winding coil according to an embodiment of the invention.
Figure 15:
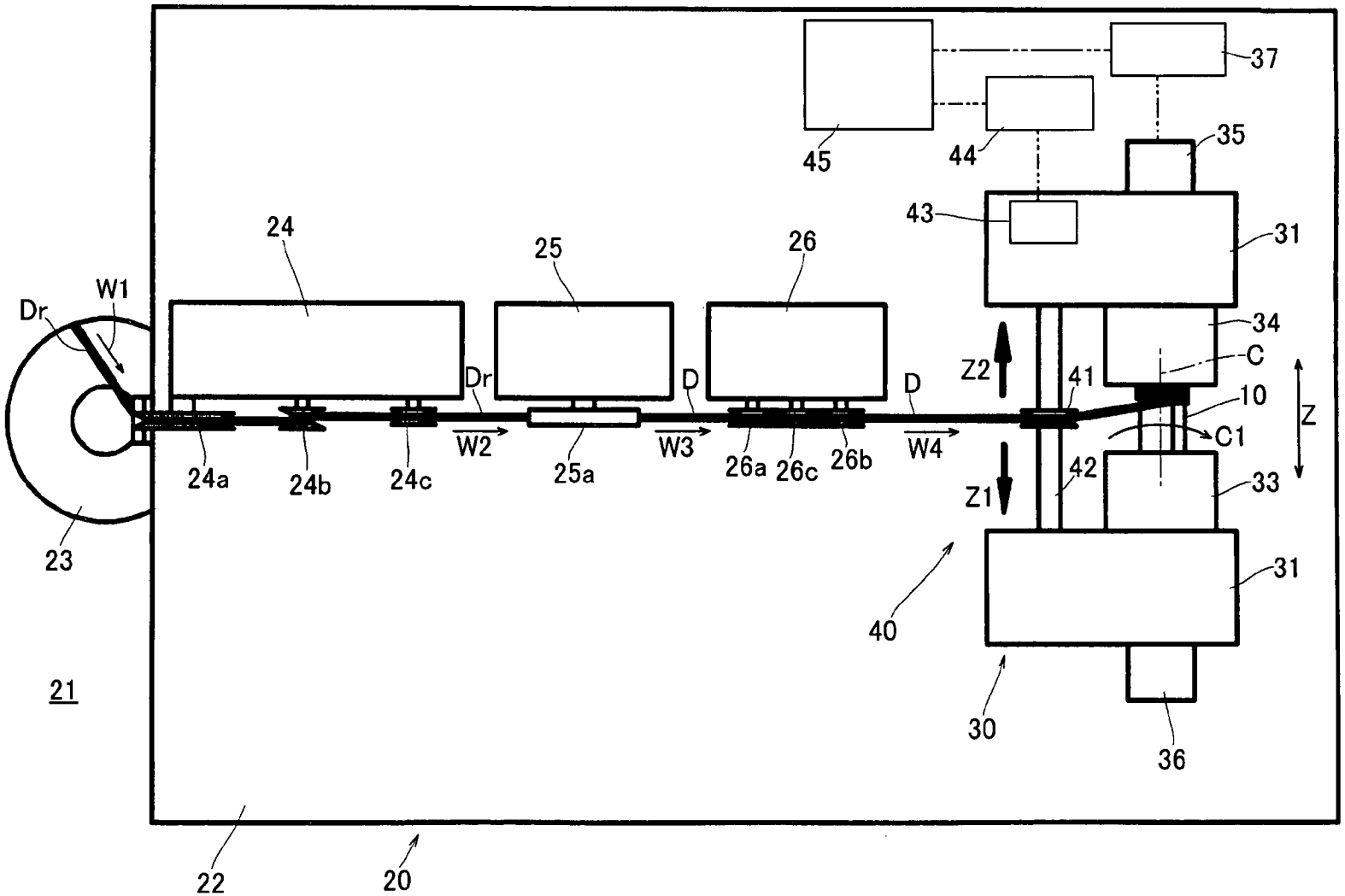
FIG. 15 is a diagrammatic plan view of the apparatus of FIG. 14.

As seen from FIGS. 14 and 15, the multilayer aligned-winding coil production apparatus 20 comprises a table 22 standing on a floor 21, a bobbin 23 which is disposed on the floor 21 and around which a round wire Dr is wound, a guide mechanism 24 for the wire, a rolling mechanism 25 for producing the rectangular wire D, a tensioning mechanism or tension-applying and adjusting mechanism 26 and a coil winding machine 30. In this example, the wire-guide mechanism 24, the rectangular wire rolling mechanism 25, the tensioning mechanism or tension-applying and adjusting mechanism 26 and the coil winding machine 30 are placed on the table 22. The round wire Dr comprises a round copper wire of circular cross-section and a dielectric layer dielectrically coating an outer surface of the copper wire, and has a thermally adhesive layer on the outer surface of the dielectric layer. However, the thermally adhesive layer may be omitted. A diameter of the copper part of the round wire Dr is, for example, about 0.02-0.2 mm, and is typically about 0.04-0.1 mm. However, the diameter may be smaller than 0.02 mm or greater than 0.2 mm. The rectangular wire D to be produced finally has an aspect ratio (ratio of long side with respect to short side), in the rectangular cross-section, of typically in the order of 3, in which the width (long side) is about 0.05-0.2 mm, while the thickness (short side) is about 0.02-0.05 mm.

The guide mechanism 24, comprises plural rollers 24*a*, 24*b* and 24*c*, draws out a round wire Dr in an upward direction W1 through a round wire guide portion 22*a* at an end of the table 22 from the bobbin 23 and turns, or changes the direction of, the round wire Dr in a generally horizontal direction W2 to be directed to the rolling mechanism 25. The round wire guide portion 22*a* gives some frictional resistance against the drawing out of the round wire Dr. The rectangular wire rolling mechanism 25 comprises a pair of rolling mill rolls 25*a*, 25*b*, and mills to change the round wire Dr pulled in the direction W3 by the tensioning mechanism 26 into a rectangular wire D. The rectangular wire D formed by the rolling mechanism 25 has typically a cross-sectional shape similar to oval rather than rectangular as described before. However, when the round wire Dr is thick and when the sizes or the cross-section of the rectangular wire D is large, the rolling mechanism may be designed to perform plural rolling processing. The tensioning mechanism 26 comprises, in addition to a pair of rollers 26*a*, 26*b*, a pulling or suspended roller 26*c*, and gives the rectangular wire D a desired magnitude of tension so that the rectangular wire D fed out from the rolling mechanism 25 can be pulled by the coil winding machine 30 at a predetermined tension. The tensioning mechanism 26 may have plural tension adjusting portions to adjust not only the tension of the rectangular wire D at an discharging side to the coil winding machine 30 but also the tension of the rectangular wire D drawn out from the rolling mechanism 25.

The coil winding machine 30 comprises cases 31, a winding core 10, rotary shaft main bodies 33, 34 supporting the winding core 10, a rotary core rotation motor 35 for driving to rotate the rotary shaft main body 34, a bearing 36 for the rotary shaft 33 and a rotation control mechanism 37 for controlling the rotation of the motor 35. Although, the rotary shaft main body 34 is described to be driven by the motor 35 in this example for convenience of illustration in drawings, the rotary shaft main body 33 integrally mounted with the winding core 10, instead of the rotary shaft main body 34, may be driven to be rotated by the motor 35. The coil winding machine 30 further comprises a traverse mechanism 40 for controlling a position of the rectangular wire D, to be wound around the winding core 10, in the axial direction C. The reference numeral 38 (FIG. 14) denotes a heater for softening or melting the thermal adhesive layer on the surface of the rectangular wire D.

The traverse mechanism 40 comprises a roller 41 for guiding the rectangular wire D along a circumferential groove at an outer periphery thereof, a position adjusting shaft 42 such as a ball screw for adjusting a position of the roller 41 in the axial direction Z, a traverse motor 43 for rotating the position adjusting shaft 42 in the forward/backward direction, and a traverse position control mechanism 44 for controlling the rotation of the traverse motor 43. The operation of the control mechanisms 37, 44 are adjusted or controlled by a central control unit 45 including a console panel. The central control unit 45 synchronously controls the drive of rotation of the motor (not shown) for driving the roll of the rolling mechanism 25.

Figure 16A:
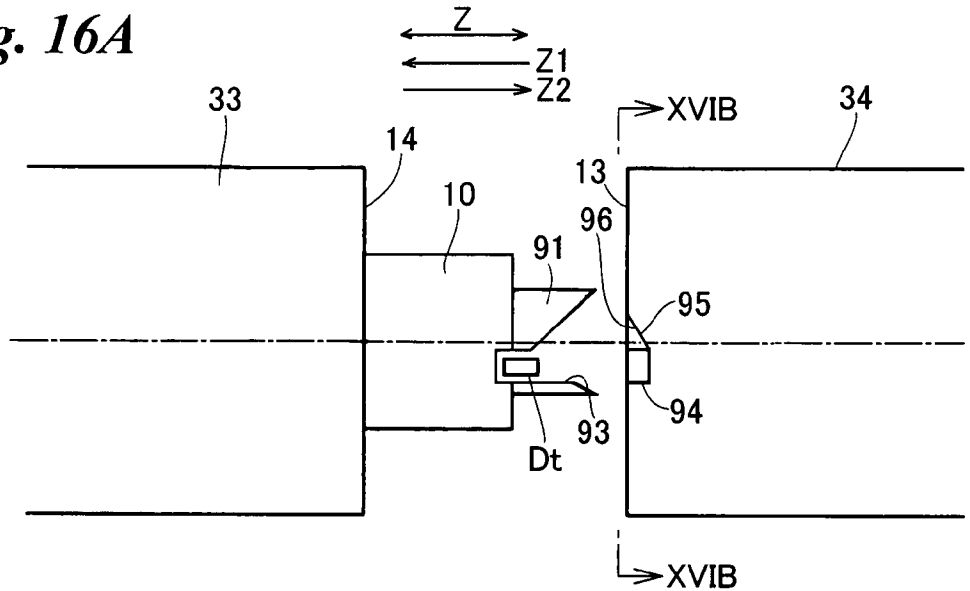
Figure 16C:
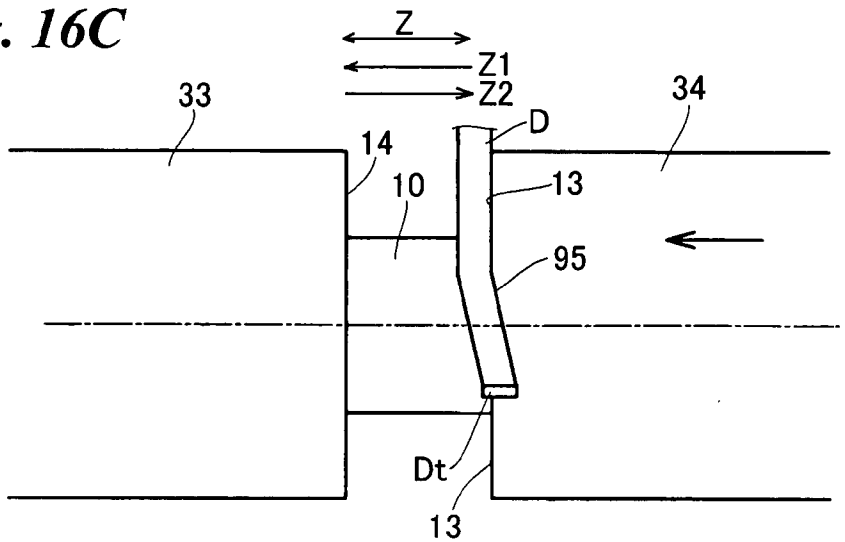
Figure 17A:
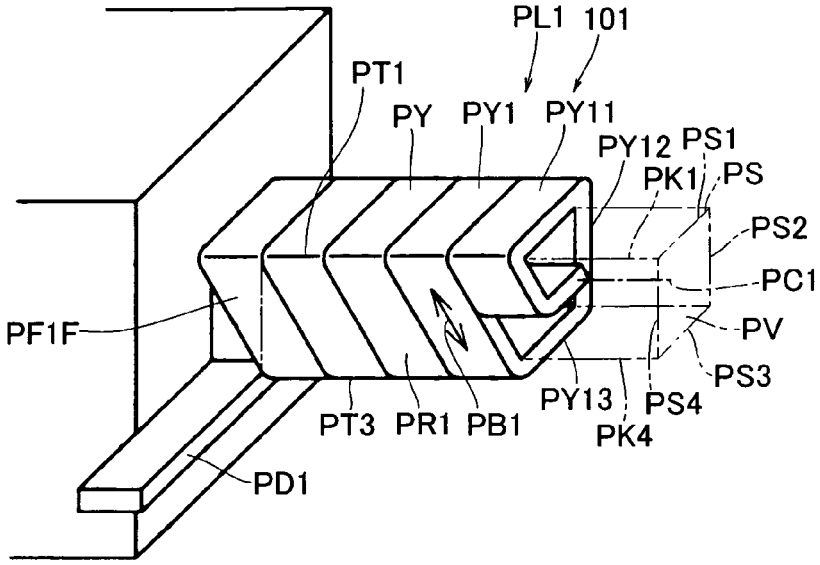
Figure 17B:
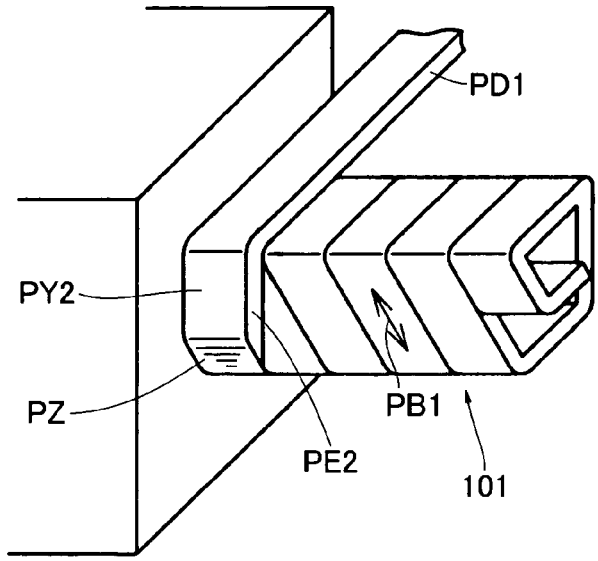
Figure 17C:
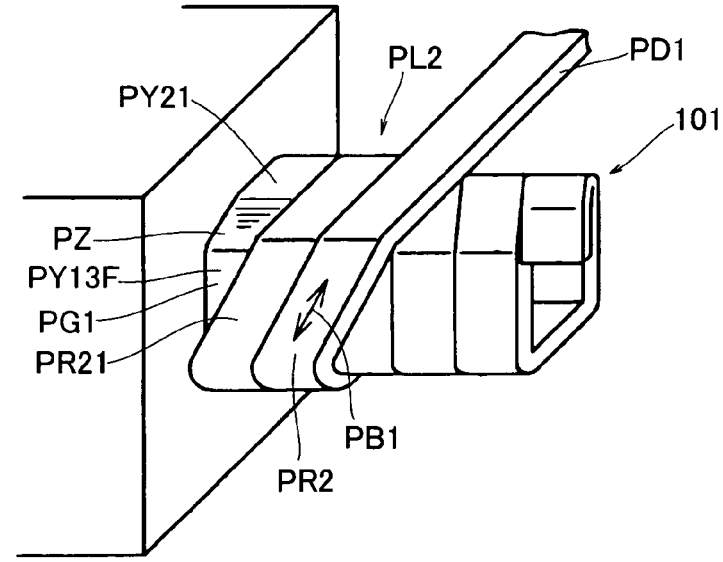
Figure 18A:
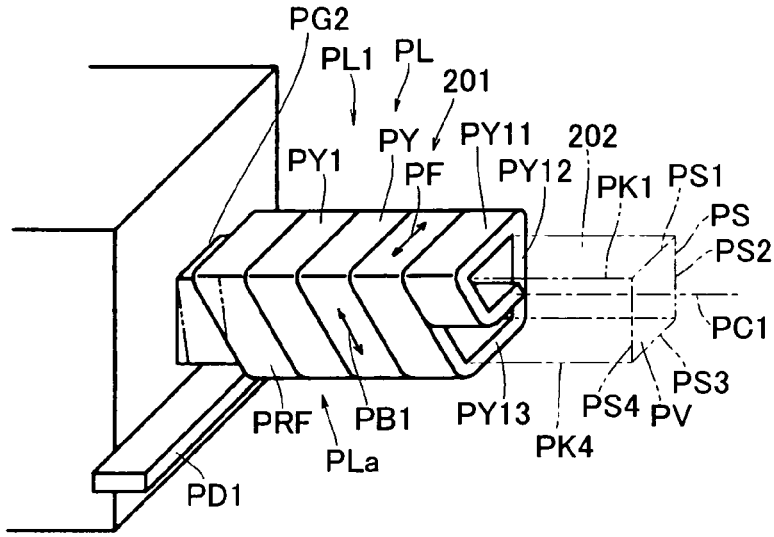
Figure 18B:
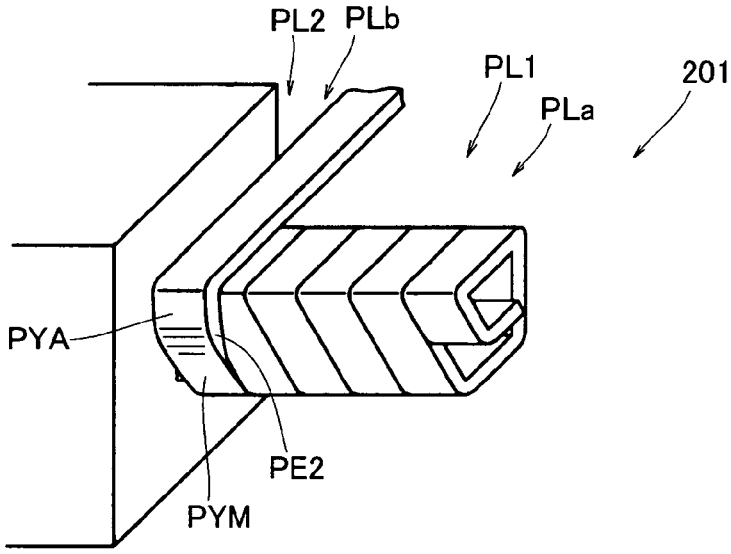
Figure 18C:
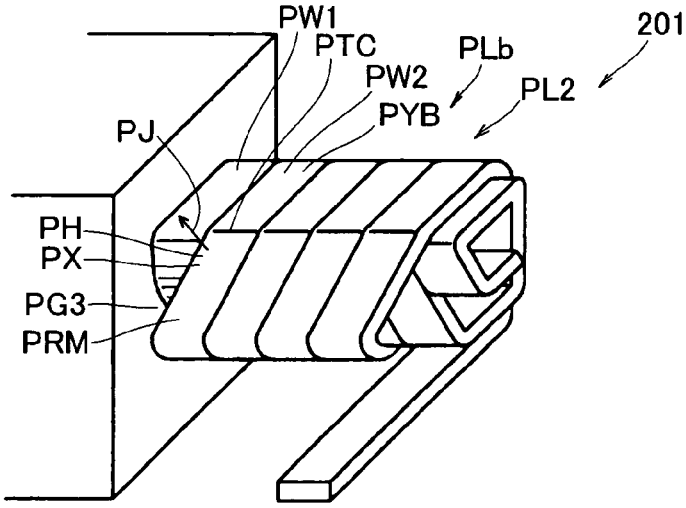
Figures 19A, 19B, 19C, 19D, 19E, 19F, 19G, 19H:
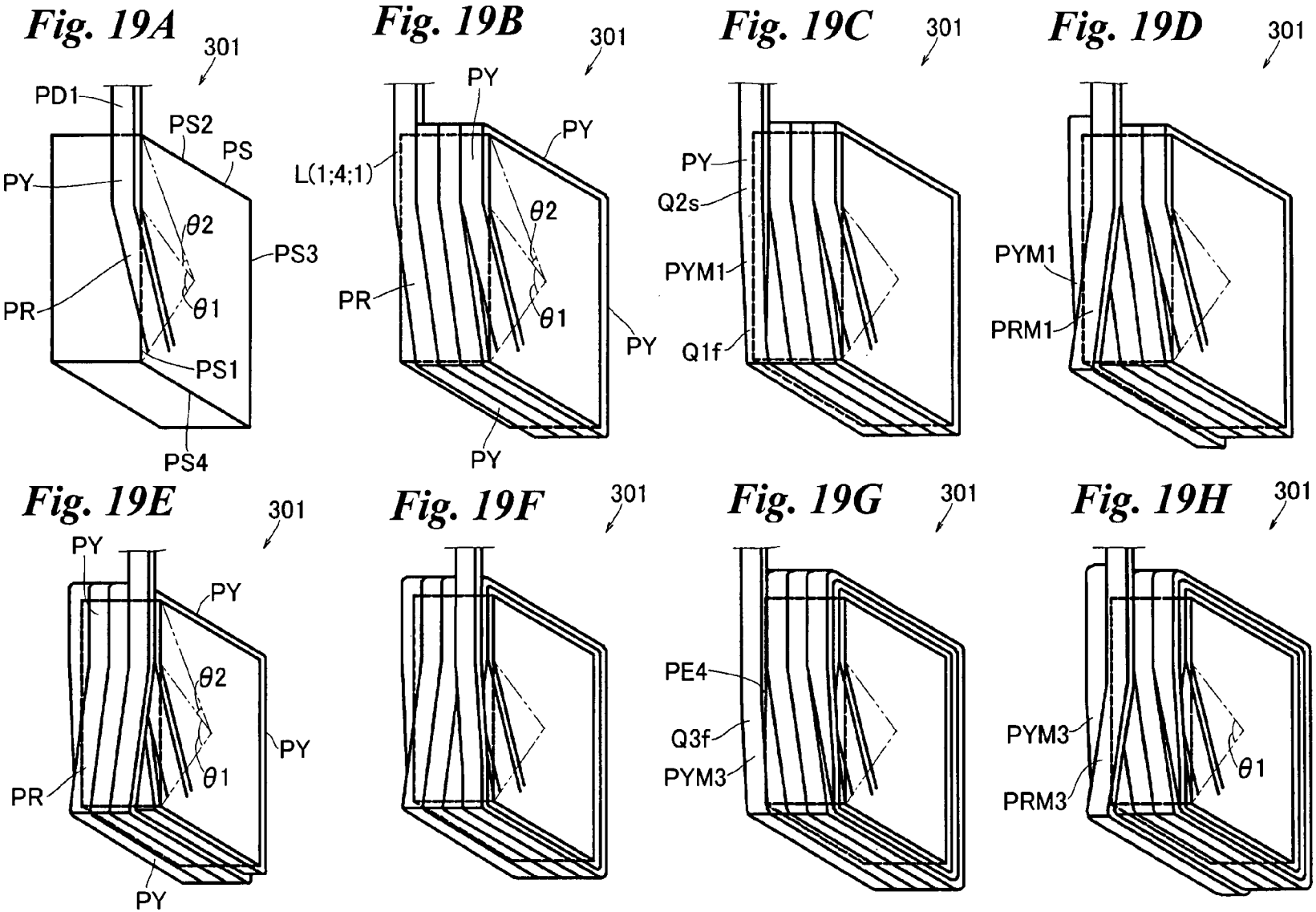
Figure 20B:
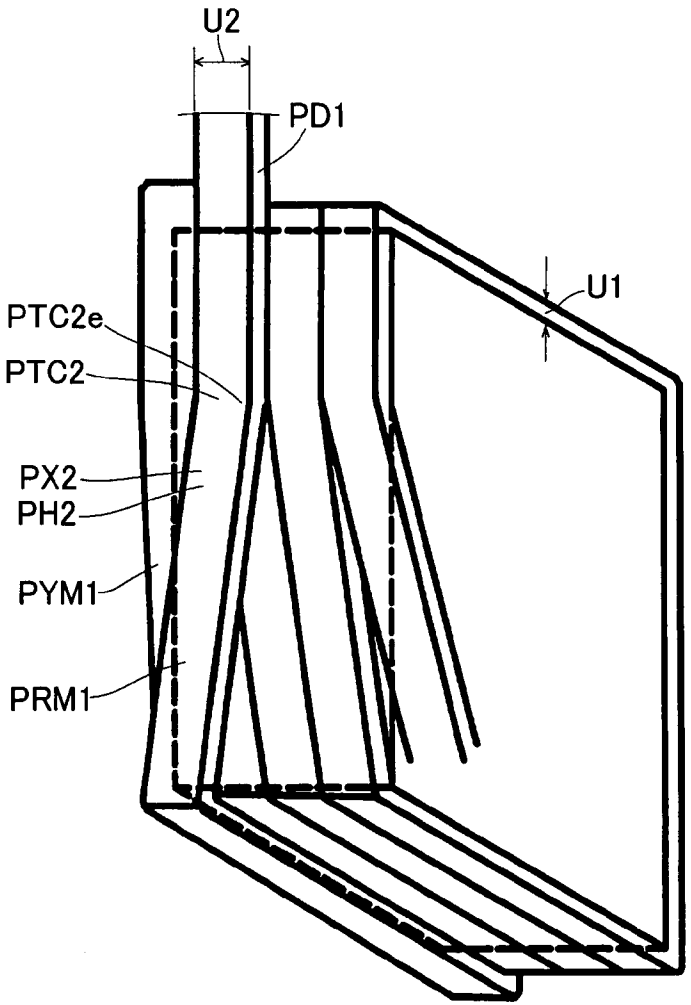
Figure 20A:
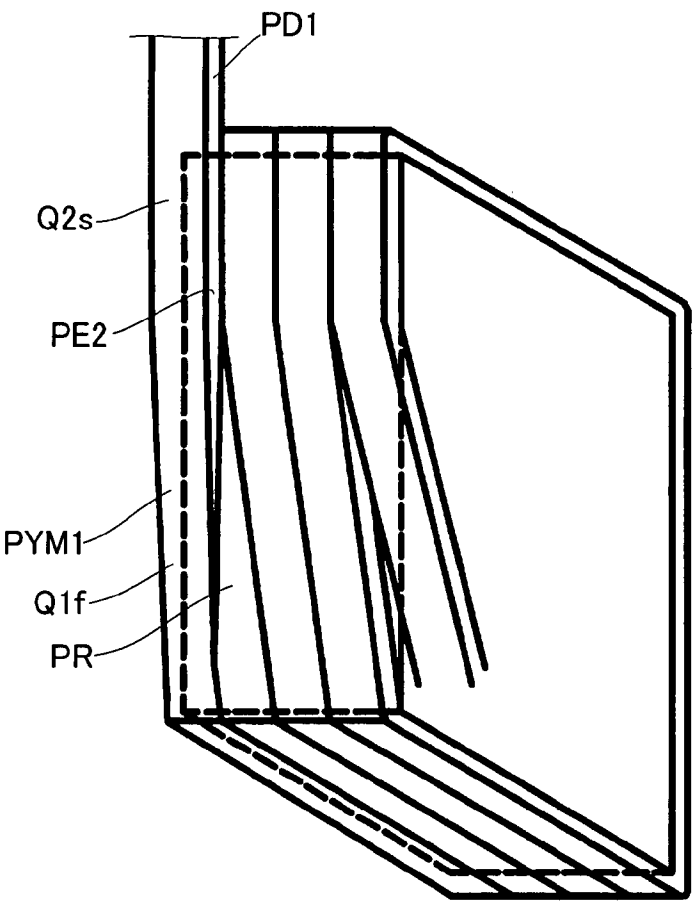
Figure 21B:
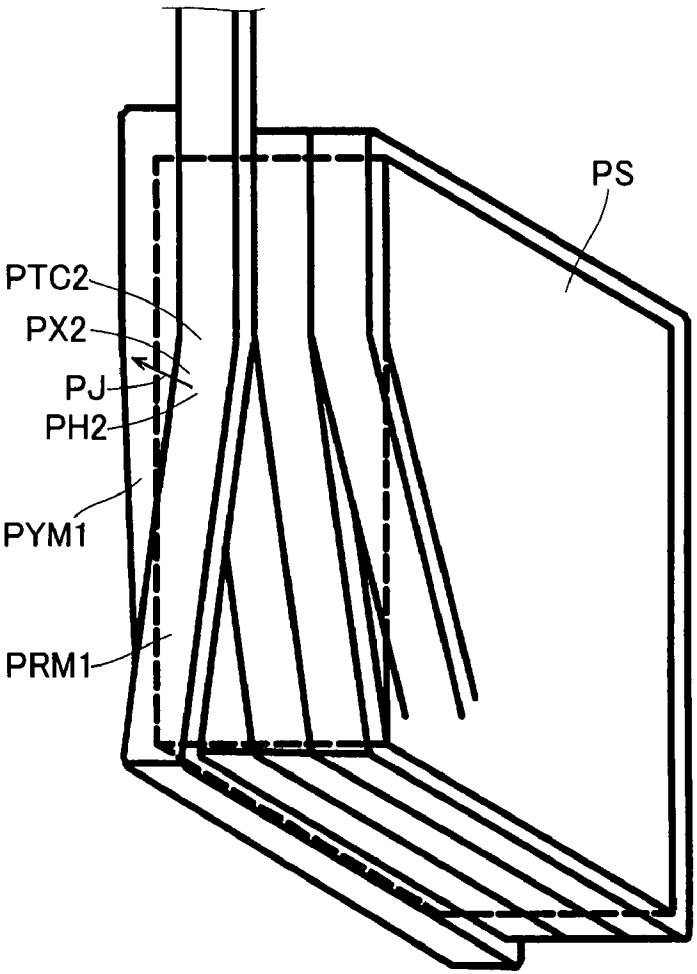
Figure 21A:
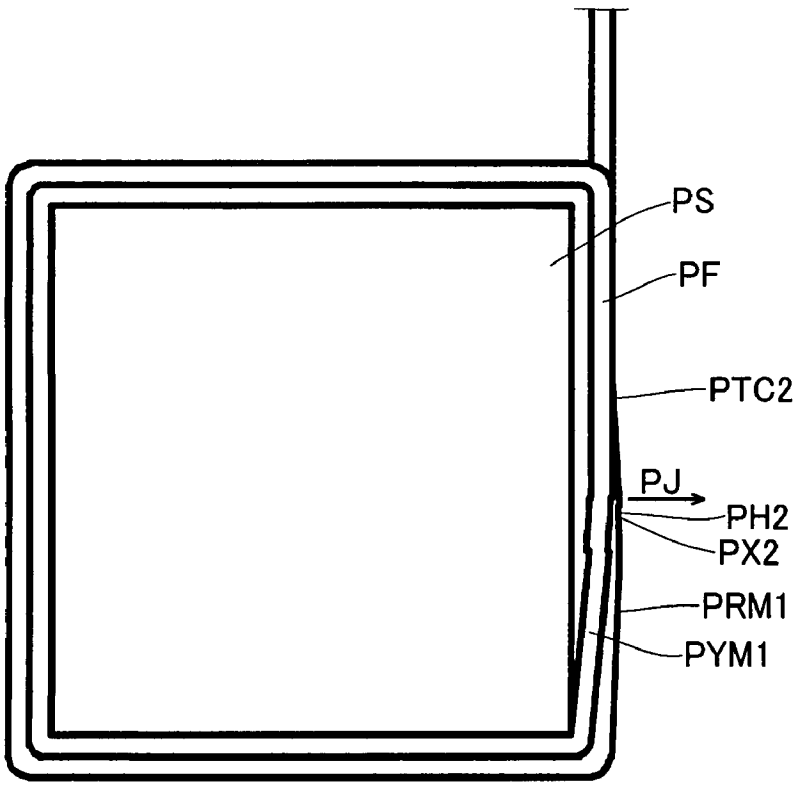
Figure 22B:
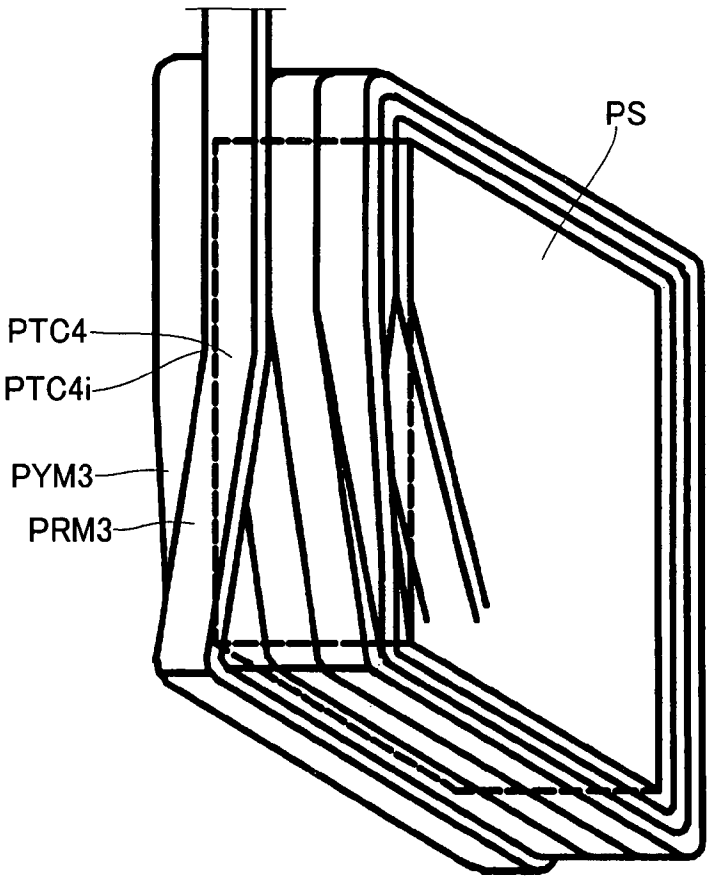
Figure 22A:
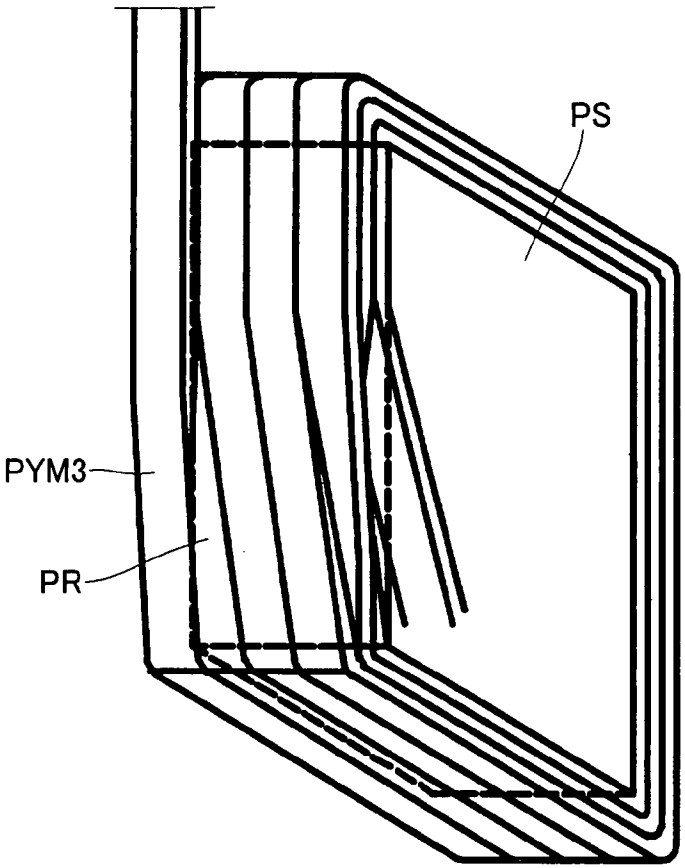
Figure 23B:
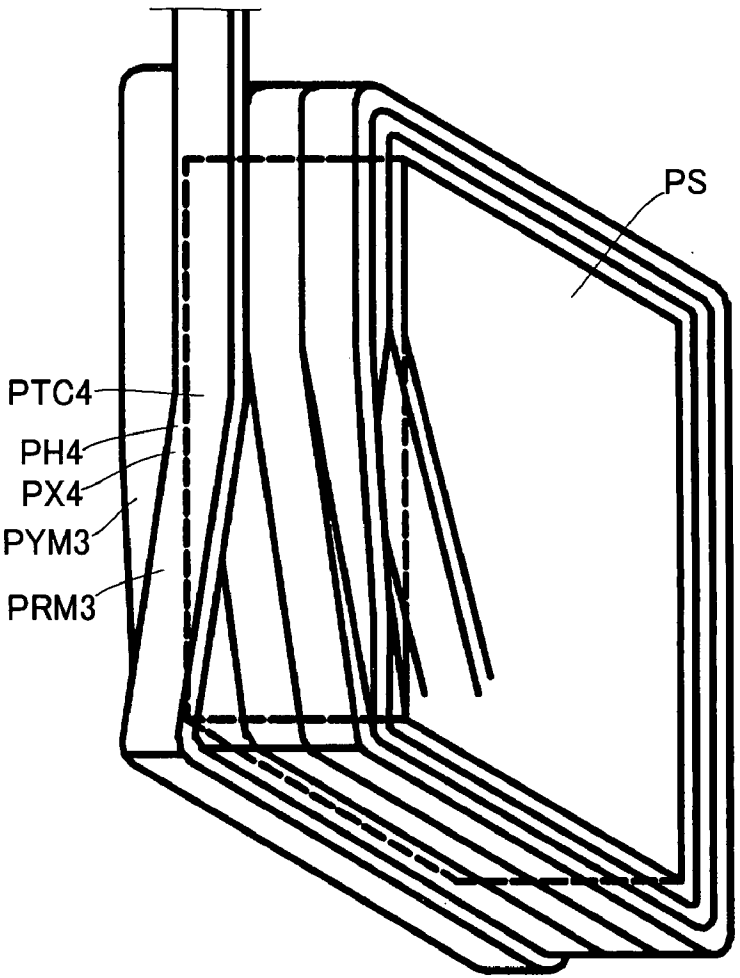
Figure 23A:
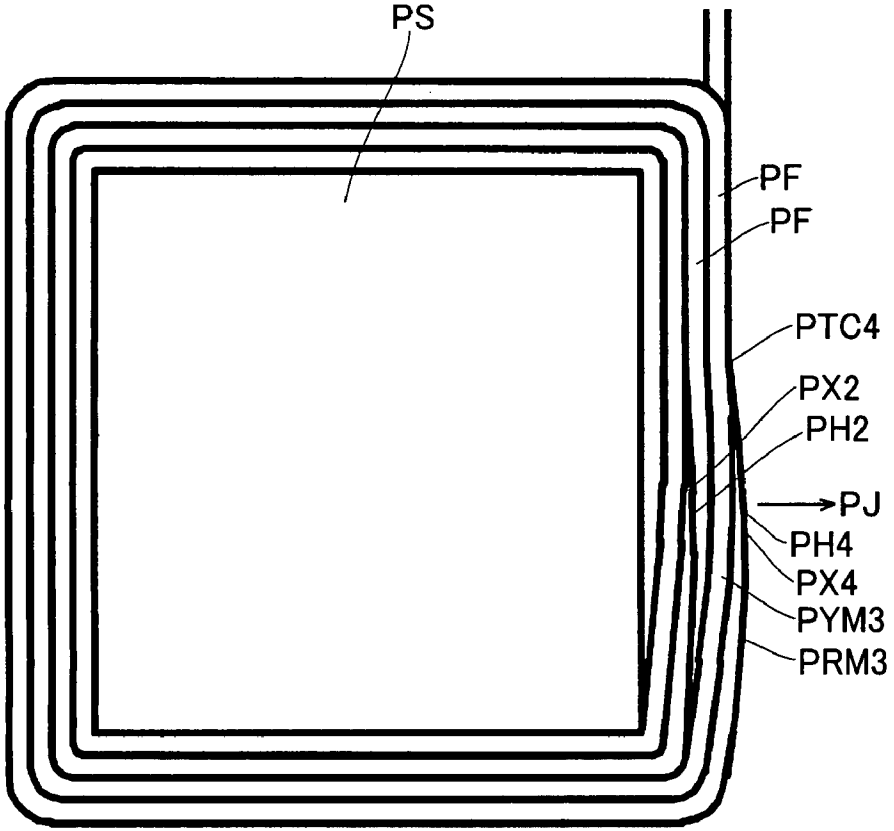

As shown in FIGS. 16A to 16C, the winding core 10 has an engaging projection 91 at a distal end, while the rotary shaft main body 34 has, in the flange-like face 13 thereof, a recess 92 in which the projection 91 is detachable fitted. A groove 93 is formed in the winding core 10 and the engaging projection 91 where the distal end Dt of the rectangular wire D for the multilayer aligned-winding coil 1 can be inserted and fixed. On the other hand, a groove 94 for fixing the distal end of the rectangular wire D cooperatively with the groove 93, and a guide recess 96 having a guide face 95 for guiding a start portion of the rectangular wire D to be wound around the winding core 10 are formed in the distal end face of the rotary shaft main body 34.

Upon forming the multilayer aligned-winding coil 1, the distal end Dt of the rectangular wire D is inserted in the groove 93, and then the projection 91 of the rotary shaft main body 33 is fitted in the recess 92 of the rotary shaft main body 34 and a portion of the wire D near the distal end Dt is extended along the guide recess 96. Thus, the winding wire D extends, as shown in FIG. 16C, along the side face P1 of the winding core 10 and is set to a state similar to that shown in FIG. 1A. The winding core 10 of the coil winding machine 30 is different in its shape or configuration from the winding core shown in FIG. 1A etc because the cross-section of the winding core 10 of the coil winding machine 30 is not square but rectangular.

Then, under the control of the central control unit 45, the rectangular wire D is formed from the round wire Dr by controlling the drive of the milling roll pair 25*a*, 25*b* of the rolling mechanism 25, and the winding wire 10 is rotated in the direction C1 by driving to rotate the winding core motor 35 through the control mechanism 37, and the traversing motor 43 is driven to be rotated through the control mechanism 44 to rotate the position control shaft 42 in the forward or backward direction for displacing the traversing roller 41 in the directions Z1, Z2, thereby winding the wire D around the winding core 10. For example, at the turning point T, as described with reference to FIG. 4B, stretching, at first, the winding wire D in a direction away from the already wound winding wire part and then swinging in the direction E1 to hit at a side edge of the winding wire part having been already wound, the winding wire D can traverse in the direction E1 by the transverse device or mechanism 40. As described before, the winding wire is wound around while the tension thereof is being adjusted so as to adjust the winding force and/or turning point as desired upon winding. It is because the rectangular wire D is made substantially of copper wire and typically has a narrow width Da in the order of 0.05-0.2 mm and a thin thickness in the order of 0.02-0.05 mm that the desired turning point T is formed only by performing a traverse control by means of the traverse decie 40 under the desired tension of the winding wire D and by synchronously rotation of the winding core 10 in the direction C1. The width Da and/or the thickness Db may be greater. In a case where the width Da and/or thickness Db are/is much greater or the rectangular wire D is made of material much higher rigidity than copper, winding assisting tool for pressing the material of the wire against the surface of the winding core 10 and/or a part of the winding wire having been alreaded wound around may be provided and such assisting tool may be controlled synchronously with the winding.

What is claimed is:

1. A multilayer aligned-winding coil, formed by winding, in alignment, a wire of wide width in the form of a multilayer tube, each layer having an obliquely crossing winding part extending obliquely with respect to a direction, which extends along a cross-section of the tube substantially perpendicular to a longitudinal axis thereof, in one continuous partial angular region of a virtual endless ring defined by the cross-section of the tube, and a transverse winding part extending transversely along the cross-section in an other partial angular region of the virtual endless ring, said multilayer aligned-winding coil including a plural pairs of consecutively superposed two layers meeting below-mentioned two conditions (1) and (2), (1) a first row of winding portion including a first transverse winding part having a progressively riding transverse winding part riding progressively on a last row of the obliquely crossing winding part of a lower layer of said two layers to reach from the lower layer to an upper layer situated thereover by one layer, and (2) a second row of winding portion including a riding and obliquely crossing winding part extending to obliquely cross from a riding start region, of said progressively riding transverse winding part, where the riding thereof on the obliquely crossing winding part is started, across a progressive riding region of sad progressively riding transverse winding part superposing at least partially on the obliquely crossing winding part, and descending at an extended end on the obliquely crossing winding part of the lower layer, said multilayer aligned-winding coil further comprising at least two pairs of said two layers among said plural pairs of said two layers including the riding and obliquely crossing winding parts of the second rows of winding portions having ride-over region parts obliquely riding over the progressively riding regions of the progressively riding transverse winding parts at mutually different angular regions of the endless ring.

2. A multilayer aligned-winding coil according to claim 1, wherein an inclination of an obliquely crossing winding part, of a lower layer of a pair of said two layers upper than a lowermost pair of said two layers among said at least two pairs of said two layers, with respect to the cross-section is smaller than an inclination of an obliquely crossing winding part, of a lower layer of the lowermost pair of said two layers among said at least two pairs of said two layers, with respect to the cross-section.

3. A multilayer aligned-winding coil according to claim 1, wherein the ride-over region parts of the riding and obliquely crossing winding parts of the second row of winding portions of three or more pairs of the two layers among said plural pairs of the two layers are situated at a mutually different angular regions of the endless ring.

4. A multilayer aligned-winding coil according to claim 1, wherein the ride-over region parts of said riding and obliquely crossing winding parts of the second rows of winding portions of at least two consecutive pairs of said two layers among said plural pairs of said two layers are situated in the same angular region of said endless ring.

5. A multilayer aligned-winding coil according to claim 4, wherein the ride-over region parts of said riding and obliquely crossing winding parts of the second rows of winding portions of two consecutive pairs of said two layers among said plural pairs of said two layers are situated in the same angular region of said endless ring.

6. A multilayer aligned-winding coil according to claim 1, wherein the endless ring has plural curvature parts of different curvatures, at least one of said ride-over region parts of said plural riding and obliquely crossing winding parts is a small curvature part having a small curvature among the different curvatures of the plural curvature parts.

7. A multilayer aligned-winding coil according to claim 6, wherein the small curvature part comprises a part where the curvature is substantially zero.

8. A multilayer aligned-winding coil according to claim 6, wherein the endless ring is substantially rectangular or oval.

9. A multilayer aligned-winding coil according to claim 1, wherein the endless ring has plural curvature parts of different curvatures, at least one of said ride-over region parts of said plural riding and obliquely crossing winding parts is a large curvature part having a large curvature among the different curvatures of the plural curvature parts.

10. A multilayer aligned-winding coil according to claim 1, wherein said second row of winding portion comprises a second transverse winding part turning at the extended end of the riding and obliquely crossing winding part to extend along a side edge, at a side of the second row, of the first row of transverse winding part in said transverse direction over the obliquely crossing winding part constituting the lower layer.

* * * * *